US005699652A

United States Patent [19]

Craig et al.

[11] Patent Number: 5,699,652

[45] Date of Patent: *Dec. 23, 1997

[54] ARTICLE PACKAGING SYSTEM

[75] Inventors: Frank Craig, Valley Park, Mo.; Joseph G. Straeter; Donald E. Weder, both of Highland, Ill.

[73] Assignee: Southpac Trust International, Inc., Oklahoma City, Okla.

[ * ] Notice: The term of this patent shall not extend beyond the expiration date of Pat. No. 5,586,425.

[21] Appl. No.: 728,883

[22] Filed: Oct. 10, 1996

Related U.S. Application Data

[63] Continuation of Ser. No. 417,477, Apr. 5, 1995, Pat. No. 5,586,425, which is a continuation of Ser. No. 954,635, Sep. 30, 1992, abandoned.

[51] Int. Cl.[6] ..... B65B 11/58

[52] U.S. Cl. ..... 53/449; 53/397; 53/448; 53/459; 53/473

[58] Field of Search ..... 47/72; 206/423; 53/54, 543, 170, 173, 175, 176, 284.7, 255, 257, 260, 261, 390, 397, 399, 448, 449, 459, 468, 473, 493, 570, 571, 580, 585

[56] References Cited

U.S. PATENT DOCUMENTS

| | | |
|---|---|---|
| 1,063,154 | 5/1913 | Bergen . |
| 1,964,689 | 6/1934 | Quillen et al. . |
| 2,302,259 | 11/1942 | Rothfuss . |
| 2,774,187 | 12/1956 | Smithers . |
| 3,271,922 | 9/1966 | Wallerstein et al. . |
| 3,358,418 | 12/1967 | Manetta . |
| 3,360,901 | 1/1968 | Gallo . |
| 3,376,666 | 4/1968 | Leonard . |
| 3,380,220 | 4/1968 | Jennings et al. . |
| 3,431,706 | 3/1969 | Stuck . |
| 3,495,378 | 2/1970 | Kipers . |
| 3,508,372 | 4/1970 | Wallerstein et al. . |
| 3,556,389 | 1/1971 | Gregoire . |
| 3,747,293 | 7/1973 | Van Slooten et al. . |
| 3,962,503 | 6/1976 | Crawford . |
| 3,977,524 | 8/1976 | Boots . |
| 4,043,077 | 8/1977 | Stonehocker . |
| 4,091,925 | 5/1978 | Griffo et al. . |
| 4,172,349 | 10/1979 | Lipes . |
| 4,333,267 | 6/1982 | Witte . |
| 4,400,910 | 8/1983 | Koudstaal et al. . |
| 4,413,725 | 11/1983 | Bruno et al. . |
| 4,561,546 | 12/1985 | Maroney . |
| 4,640,079 | 2/1987 | Stuck . |
| 4,733,521 | 3/1988 | Weder et al. . |
| 4,773,182 | 9/1988 | Weder et al. . |
| 4,801,014 | 1/1989 | Meadows . |
| 4,835,834 | 6/1989 | Weder . |
| 4,897,031 | 1/1990 | Weder et al. . |
| 4,901,423 | 2/1990 | Weder . |
| 4,980,209 | 12/1990 | Hill . |
| 5,105,599 | 4/1992 | Weder . |
| 5,111,638 | 5/1992 | Weder . |
| 5,120,382 | 6/1992 | Weder . |
| 5,157,899 | 10/1992 | Tas . |
| 5,199,242 | 4/1993 | Weder et al. . |
| 5,205,108 | 4/1993 | Weder et al. . |
| 5,235,782 | 8/1993 | Landau . |
| 5,249,407 | 10/1993 | Stuck . |

*Primary Examiner*—Daniel Moon
*Attorney, Agent, or Firm*—Dunlap & Codding, P.C.

[57] ABSTRACT

The present invention is a modular system for packaging articles for shipment. In particular, a potted plant is sorted according to a grade, placed in a decorative cover, then automatically deposited into a protective sleeve. The potted plant thus packaged is ready for containment within a shipping carton. Various components of the system may be adapted for various packaging needs and circumstances.

8 Claims, 18 Drawing Sheets

ARTICLE PACKAGING SYSTEM

CROSS-REFERENCE TO RELATED APPLICATIONS

This application is continuation of U.S. Ser. No. 08/417,477, filed Apr. 5, 1995, now U.S. Pat. No. 5,586,425 entitled ARTICLE PACKAGING SYSTEM, which is a continuation of U.S. Ser. No. 07/954,635, filed Sep. 30, 1992, entitled ARTICLE PACKAGING SYSTEM, now abandoned.

FIELD OF THE INVENTION

The present invention relates generally to a system for packaging articles for shipment and, more particularly, but not by way of limitation, to a system for automatically packaging potted plants for shipment.

BRIEF DESCRIPTION OF THE DRAWINGS

FIG. 6 is a plan view of one embodiment for a cover placing station which may be used with the article packaging system.

FIG. 29A is an elevational view of another cover supplying device which may be used in an article packaging system.

FIG. 29B is a plan view of the cover supplying device of FIG. 29A.

DESCRIPTION OF THE PREFERRED EMBODIMENTS

Figure 1:
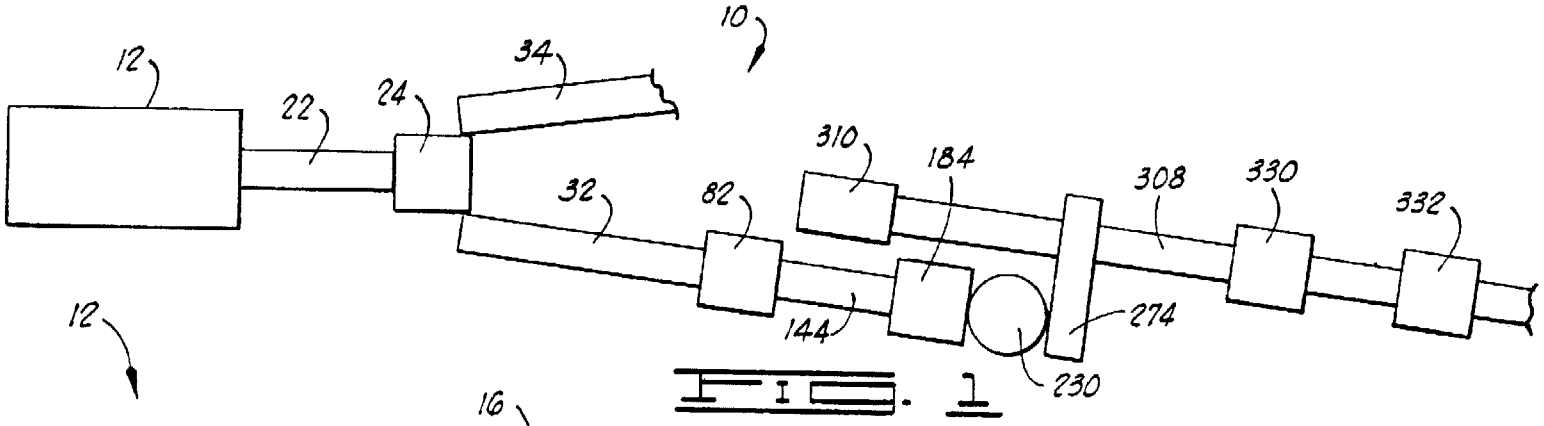
FIG. 1 is a schematic of an article packaging system which is constructed in accordance with the present invention.
Figure 2:
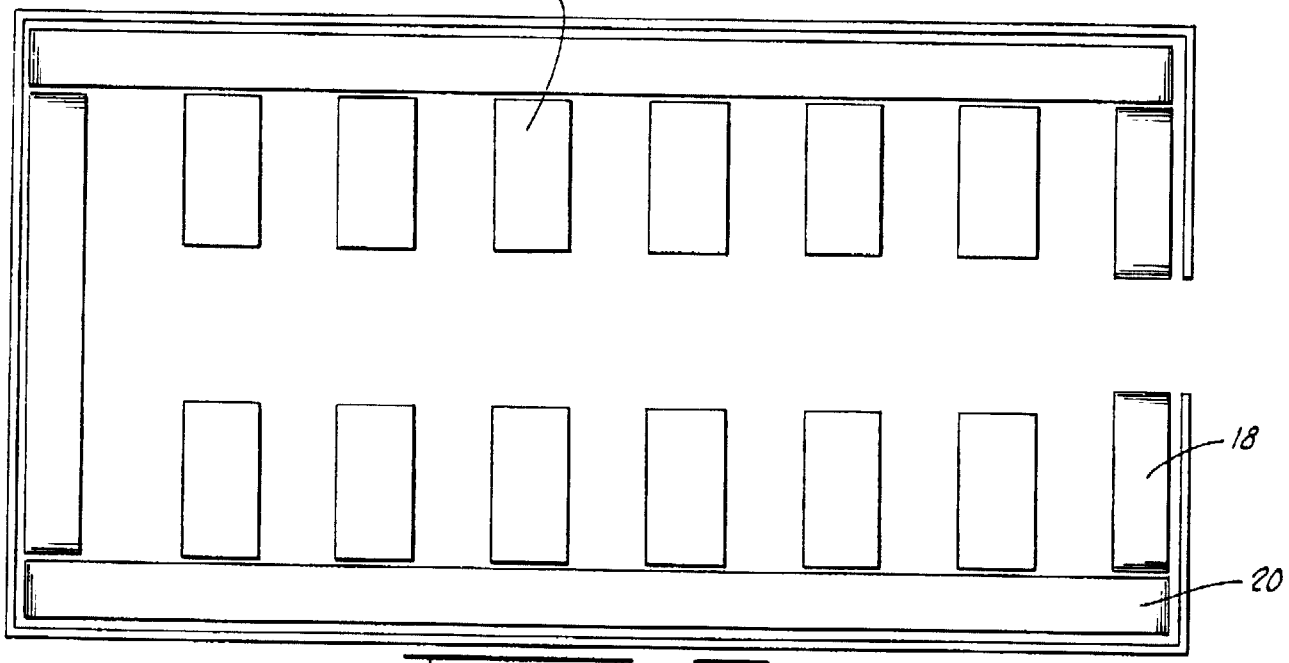
FIG. 2 is a plan view of part of the packaging system of FIG. 1 showing an automated greenhouse.

The present invention, an article packaging system, is described herein as being adapted to process potted plants. However, a potted plant represents only one article which can be processed with the present invention and the present invention specifically contemplates various and numerous other types of articles such as; vases, hats (including cowboy hats, fedoras, caps, derbies, sombreros, fezzes and helmets), rose stem boxes, flower pots, candy trays, baskets (such as Easter or decorative baskets), corsage boxes, containers, and various other articles. The term "article" as used herein is intended to encompass all of the specific articles just mentioned and the term"article" also is intended to be broad enough to encompass any other article which may be decorated, sleeved, and then packed for shipping.

The term "potted plant" as used herein means a botanical item and the pot, such as a flower pot, within which the botanical item is contained. The potted plant has potting soil or any other growth medium or filler, such as foam, known in the art to secure a plant or other botanical item within a pot. One end of the botanical item is secured in the pot and the other end exposed through the opening in the flower pot. The potted plant has an exterior surface comprising the outer surface of the pot, about which a decorative cover may be placed or applied.

The term "botanical item" as used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping. The term "propagule" as used herein means any structure capable of being propagated or acting as an agent of reproduction including seeds, shoots, stems, runners, tubers, plants, leaves, roots or spores. The term "growing medium" used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth. The term "flower pot" means any type of floral container used to hold a botanical item. Examples of flower pots used in accordance with the present invention include clay flower pots, plastic flower pots, and flower pots comprised of other natural or synthetic materials.

The present invention particularly contemplates the preparation of potted plants for shipment. More particularly a potted plant may be covered with a formed sheet of decorative material formed into a decorative cover having an interior surface, exterior surface and an interior space adjacent and surrounded by the interior surface such as that formed in a mold type article forming system described in detail in U.S. Pat. No. 4,773,182 issued to Weder et al. on Sep. 27, 1988 and which is hereby specifically incorporated herein by reference.

A decorative pattern, such as a color and/or an embossed pattern, and/or other decorative surface ornamentation may be applied to the upper surface and/or the lower surface of the sheet of material comprising the decorative cover or portions thereof including, but not limited to printed design, coatings, colors, flocking or metallic finishes. The sheet of material comprising the cover also may be opaque, translucent, or totally or partially clear or tinted transparent material.

The sheet of material may be constructed of a single sheet of material or a plurality of sheets. Any thickness of the sheet of material may be utilized in accordance with the present invention as long as the sheet of material may be wrapped about at least a portion of a flower pot or deposited within a sleeve, as described herein. The sheet of material may have a thickness of less than about 1 mil to about 30 mils. Typically, the sheet of material has a thickness in a range of less than about 0.2 mils to about 10 mils. In a preferred embodiment, the sheet of material is constructed from one sheet of man-made organic polymer film having a thickness in a range of from less than about 0.5 mils to about 2.5 mils.

The sheet of material is constructed from any suitable material that is capable of being wrapped about a flower pot. Preferably, the sheet of material comprises paper (untreated or treated in any manner), cellophane, foil, synthetic organic polymer film, fiber (woven or nonwoven or synthetic or natural), cloth (woven or nonwoven or natural or synthetic), burlap, or any combination thereof.

The term "synthetic organic polymer film" means a synthetically made resin such as a polypropylene as opposed to naturally occurring resins such as cellophane. A synthetic organic polymer film is relatively strong and not as subject to tearing (substantially non-tearable), as might be the case with paper or foil. The synthetic organic polymer film is a substantially linearly linked. Such films are synthetic polymers formed or synthesized from monomers. Further, a relatively substantially linearly linked processed organic polymer film is virtually waterproof which may be desirable in many applications involving wrapping botanical items or potted plants.

Additionally, a relatively thin film of substantially linearly linked processed organic polymer does not substantially deteriorate in sunlight. Processed organic polymer films having carbon atoms both linearly linked and cross linked, and some cross linked polymer films, also may be suitable for use in the present invention provided such films are substantially flexible and can be made in a sheet-like format for wrapping purposes consistent with the present invention. For example, one such man-made organic polymer film is a polypropylene film.

The sheet of material may vary in color. Further, the sheet of material may consist of designs which are printed, etched, and/or embossed; in addition, the sheet of material may have various colorings, coatings, flocking and/or metallic finishes, or be characterized totally or partially by pearlescent, translucent, transparent, iridescent, or the like, characteristics. Each of the above-named characteristics may occur alone or in combination. Moreover, each surface of the sheet of material may vary in the combination of such characteristics.

The sheet of material has a width extending generally between the first side and the second side respectively, sufficiently sized whereby the sheet of material can be wrapped about and substantially surround and encompass a flower pot. The sheet of material has a length extending generally between the third side and the fourth side, respectively, sufficiently sized whereby the sheet of material extends over a substantial portion of the flower pot when the sheet of material has been applied about the flower pot in accordance with the present invention shown and described in detail herein.

The sheet of material may further comprise at least one scent. Examples of scents utilized herein include (but are not limited to) floral scents (flower blossoms, or any portion of a plant), food scents (chocolate, sugar, fruits), herb or spice scents (cinnamon), and the like. Additional examples of scents include flowers (such as roses, daisies, lilacs), plants (such as fruits, vegetables, grasses, trees), foods (for example, candies, cookies, cake), food condiments (such as honey, sugar, salt), herbs, spices, woods, roots, and the like, or any combination of the foregoing. Such scents are known in the art and are commercially available.

The scent may be disposed upon the sheet of material by spraying the scent thereupon, painting the scent thereupon, brushing the scent thereupon, lacquering the scent thereupon, immersing the sheet of material to scent-containing gas, or any combination thereof.

The scent may be contained within a lacquer, or other liquid, before it is disposed upon the sheet of material. The scent may also be contained within a dye, ink, and/or pigment (not shown). Such dyes, inks, and pigments are known in the art, and are commercially available, and may be disposed upon or incorporated in the sheet of material by any method described herein or known in the art.

The decorative cover may be bonded to the article or potted plant by a bonding material. The term "bonding material" as used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable, sonic sealable and, vibratory sealable in these instances, the adjacent portions of the material must be brought into contact and then heat, sound waves or vibrations, respectively, must be applied to effect the seal.

The term "bonding material" as used herein also means a heat sealing lacquer which may be applied to the sheet of material and, in this instance, heat also must be applied to effect the sealing. The term "bonding material" as used herein means any type of material or thing which can be used to effect the bonding or connecting of the two adjacent portions of the material or sheet of material to effect the connection or bonding described herein. The term"bonding material" also includes ties, labels, bands, ribbons, strings, tape, staples or combinations thereof.

The decorated article covered with a decorative cover may then be placed in a sleeve to generally protect it during shipping. For example, a potted plant may be sleeved to preserve water and carbon dioxide for the plant, and to protect the plant during shipping. The sleeve may be made from an impermeable material which would retain all gases and liquids or from a semi-permeable material, such as a material which would allow oxygen and carbon dioxide to pass, but would inhibit the passage of water through the material.

Sleeves are well known in the art of packaging potted plants. As used herein, a sleeve is cylindrical, conical or frusto-conical in shape and has an upper opening, which provides an opening for the deposit of a potted plant, or other article, therein. Sleeves may be comprised of any flexible material suitable for covering a potted plant, including materials selected from a group of materials, comprising paper, metal, foil cloth (natural or synthetic), denim, burlap, or polymer film, or combinations thereof. The term polymer film as used herein means any polymer film, including for example, but not by way of limitation, polypropylene film and cellophane. The material comprising the sleeve may be opaque, translucent, or totally or partially transparent and may be decorated with designs or tints.

The article, after having been placed in a sleeve, may then be placed in a container for shipping. The container, such as a box, carton or crate, may then be sealed and marked for easy identification. The present invention provides an automated line for preparing articles for shipping in the manner just described thereby saving the seller considerable labor expense and reducing the preparation time required for packaging articles.

In describing the preferred embodiment, a potted plant will be used as an example of the article being processed. However, as discussed above the invention may be used on various other articles.

EMBODIMENTS OF FIGS. 1–21

Turning now to FIG. 1, an article packaging system designated by the reference numeral 10 is shown which is constructed in accordance with the present invention. The article packaging system 10 is adapted to transport an article from a storage location, place a decorative cover over or around the article, place the covered article in a sleeve, and pack the sleeved article in a carton for shipping.

A storage location such as a greenhouse, hereby designated by the reference numeral 12, supplies potted plants 14 (FIG. 3) for processing. The greenhouse 12 is frame covered with a material which will allow the radiant energy from the sun to reach potted plants 14 which are grown inside. Such structures are common in the art. Within the greenhouse 12 are growing racks 16 adapted for holding potted plants 14 while they are grown. The greenhouse 12 may be automated by installing conveyors, 18 and 20, adapted for transporting the potted plants 14 into and out of the greenhouse 12. Conveyors 18 and 20 may also serve as additional growing racks. Each conveyor, 18 or 20, should be reversible so it may serve to bring potted plants 14 into the greenhouse 12 or supply potted plants 14 from the greenhouse 12. Each conveyor 18 or 20 may be similar in construction. The construction details of the conveyors are not required herein as they are well known to persons of ordinary skill in the art.

As indicated in FIG. 1, a conveyor 22 extends from the greenhouse 12 to a sorting station 24. The sorting station 24 may be a manual sorting station 26 (FIG. 3) or an automatic sorting station 28 (FIG. 4). The manual sorting station 26 comprises a table 30 which receives the potted plants 14 from the conveyor 22. An operator (not shown) standing near table 30 may select a potted plant 14, in accordance with a predetermined grading criterion such as size and grade, and place it on a conveyor assembly 32 or a conveyor assembly 34 with other potted plants (not shown) of a similar grade. The potted plants 14 are sorted into one of at least two grades. Conveyors 32 or 34 should begin near the manual sorting station 26 and transport the potted plants 14 on to the next area for further processing.

In an alternative embodiment (not shown), the manual operator at station 26 may select potted plants 14 directly from the conveyor 22 and grade and place them directly from the conveyor 22 to conveyors 32 and 34 thereby eliminating the need for table 30.

In the automatic sorting embodiment of FIG. 4, the automatic sorting station 28 may be any one several apparatuses for sorting the potted plants 14. One embodiment of an automatic sorting station 28 is shown in FIG. 4 and comprises a first positioning gate 36 and a second positioning gate 38, a light source assembly 40, a light sensor assembly 42 which is comprised of at least one sensing device such as a photoelectric cell 43 and a support backing 44, a light switch 45 and a gate 46 all located near the discharge end of conveyor 22.

Figure 4:
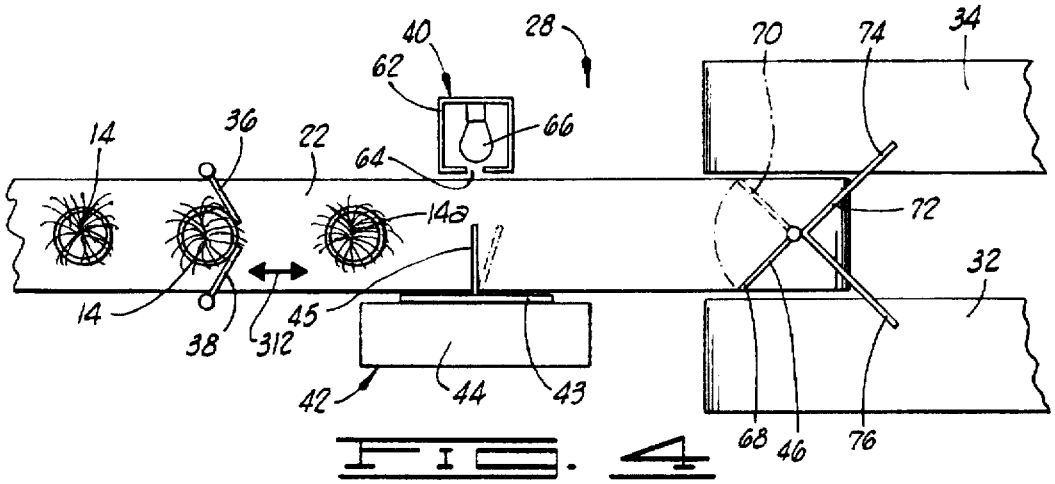
FIG. 4 is a plan view of an automatic sorting station which may be used in the article packaging system.
Figure 5:
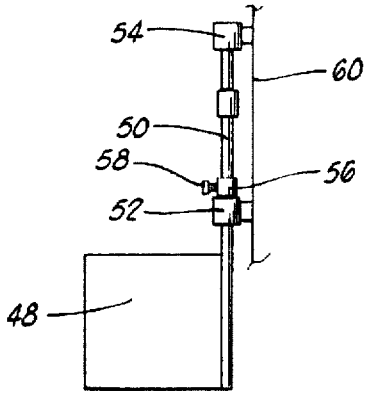
FIG. 5 is an elevational view of a gate constructed in accordance with the invention.

Referring now to FIGS. 4 and 5, the positioning gates 36 and 38 are similar in construction. Each positioning gate 36 or 38 has an arm 48 (FIG. 5). The arm 48 is preferably made from a strip of stainless steel about four to eight inches tall and of sufficient length to reach half way across conveyor 22. One end of the arm 48 is secured as by welding to a rod 50. The rod 50 extends up from the arm 48 through bearing 52, and on to motor 54. A collar 56 is secured to rod 50 above the bearing 52 by a set screw 58, thereby holding the arm 48 up off the upper surface of the conveyor 22. The bearing 52 is secured to a brace 60 which is mounted to the side of conveyor 22.

The positioning gates 36 and 38 are secured to opposite sides of the conveyor 22 and they work in conjunction to release potted plants 14 at regular intervals. In addition to spacing the potted plants 14 along the conveyor 22, the positioning gates 36 and 38 also position the potted plants 14 generally in the center of conveyor 22. Therefore, all potted plants 14 are positioned approximately the same distance from the light sensor assembly 42 as they pass in front of it.

With continued reference to FIG. 4, the light source assembly 40 is comprised of a housing 62 having a slot 64 formed on the side adjacent the conveyor 22. The housing 62 is secured on one side of the conveyor 22 such that the slot 64 is on the side of the housing 62 which faces the conveyor 22. At least one light source 66 such as a light bulb is secured within the housing 62 so that light emitted by the light source 66 passes through the slot 64 and across the conveyor 22.

Directly across conveyor 22 from the light source assembly 40 is the light sensor assembly 42.

A light switch 45 is located in front of the light source assembly 40 and turns on the light source 66 when a potted plant 14 is between the light source assembly 40 and the light sensor assembly 42. Since the potted plant 14 is between the light source assembly 40 and the light sensor assembly 42 when the light source 66 is turned on, the amount of light reaching the light sensor assembly 42 depends the size and density of the foliage on the plant 14. The taller and more dense the foliage, the less light reaches light sensor assembly 42.

Gate 46 is located down stream from the light sensor assembly 42 near the end of conveyor 22. The gate 46 is similar in construction to positioning gate 36. The brace 60 of gate 46 is positioned over the center of conveyor 22. The gate 46 is pivoted to a first position 68 or second position 70 depending on the amount of light hitting light sensor assembly 42. The action of gate 46 is controlled by a control assembly (not shown) which detects the degree of light detected by the photoelectric cell 43 and responds accordingly.

While the potted plant 14 is between the light source 66 and the photoelectric cell 43, the plant may be rotated by a rotating device (not shown). In this way light can be sensed and measured at several points of rotation of the foliage of the potted plant 14, thereby measuring an average amount of detected light which may provide a more accurate grading system for the foliage of the potted plants 14. Alternatively, instead of being rotated, several light readings could be measured at several points along the conveyor 80, for example, with the light readings taken at different angles to the foliage, to derive an average of the several readings.

Directly downstream from the gate 46 is a positioning bar 72. The positioning bar 72 is V shaped and is positioned so the point of the V is directly down stream from brace 60 of gate 46. A first end 74 and a second end 76 of the bar 72 extends off a side of conveyor 22 and onto an adjacent conveyor. First end 74 extends from conveyor 22 to conveyor 34. Second end 76 extends from conveyor 22 to conveyor 32. Conveyors 32 and 34, first may lead to similarly constructed processing lines and thus, only one such line is described below.

In an alternative embodiment (not shown), the potted plants 14 can be graded on the basis of the difference between a known tare weight of the pot and soil and the weight of potted plant. If the tare weight of the pot and saturated soil contained therein is known, this measurement can be subtracted from weight of a potted plant having saturated soil. The difference in weight is an approximate measure of the weight of the plant. This enables the classification, or grading, of the potted plant 14 on the basis of the criterion of weight, rather than of the basis of the amount of light reaching a light sensor 42, which represents foliage density.

Other automatic methods of grading the potted plants 14 are to use other forms of electromagnetic radiation such as radar (not shown) or an infra-red light sensing device (not shown) which grades the plant by detecting the amount of heat the plant gives off.

The embodiment of the article processing system described herein envisions only a single sorting station 24 to grade the potted plants 14. However, it will be appreciated by one of ordinary skill in the art that additional sorting stations 24 could be located downstream of either conveyor assemblies 32 or 34 to provide additional grading of the potted plants 14.

Conveyor assembly 32 moves the potted plants 14 to a covering station 82. The covering station 82 may be embodied in a variety of different forms as described and shown below.

In one embodiment, the covering station 82 includes a first gate 84 and a second gate 86, a turnstile 88 and a cover denesting sub-unit 90. The gates 84 and 86 are secured to opposite sides of the conveyor 32 and work in conjunction to release potted plants 14 at regular intervals. In addition to spacing the potted plants 14 along the conveyor 32 the gates 84 and 86 also position the potted plants 14 in the center of conveyor 32. Therefore, all potted plants 14 are positioned to be received by the turnstile 88.

The turnstile 88 and the cover denesting sub-unit 90 may be mounted on a platform 92 with a plurality of locking casters 94 (FIG. 7), thus, they may be rolled to the side and replaced with a section of conveyor (not shown) when covering the article is not a required step.

The turnstile 88 has a conduit 98 with a first end 100 and a second end 102. The first end 100 is secured to the platform 92. The turnstile 88 has a turnstile axle 104 which has a first end 106 and a second end 108. The second end 102 of the conduit 98 is open for accepting first end 106 of the turnstile axle 104. The diameter of the first end 106 of the turnstile axle 104 is slightly smaller than the diameter of the lumen in the conduit 98. This allows the turnstile axle 104 to rotate freely within the conduit 98.

A drive assembly mount 110 is secured near the second end 102 of the conduit 98. Secured to the drive assembly mount 110 is a drive assembly 112 with a rotatable shaft 114. Secured to the rotatable shaft 114 is a first gear 116. A second gear 118 is secured to the turnstile axle 104 between the first end 106 and the second end 108 thereof, and in a position such that the first gear 116 and second gear 118 mesh.

Figure 7:
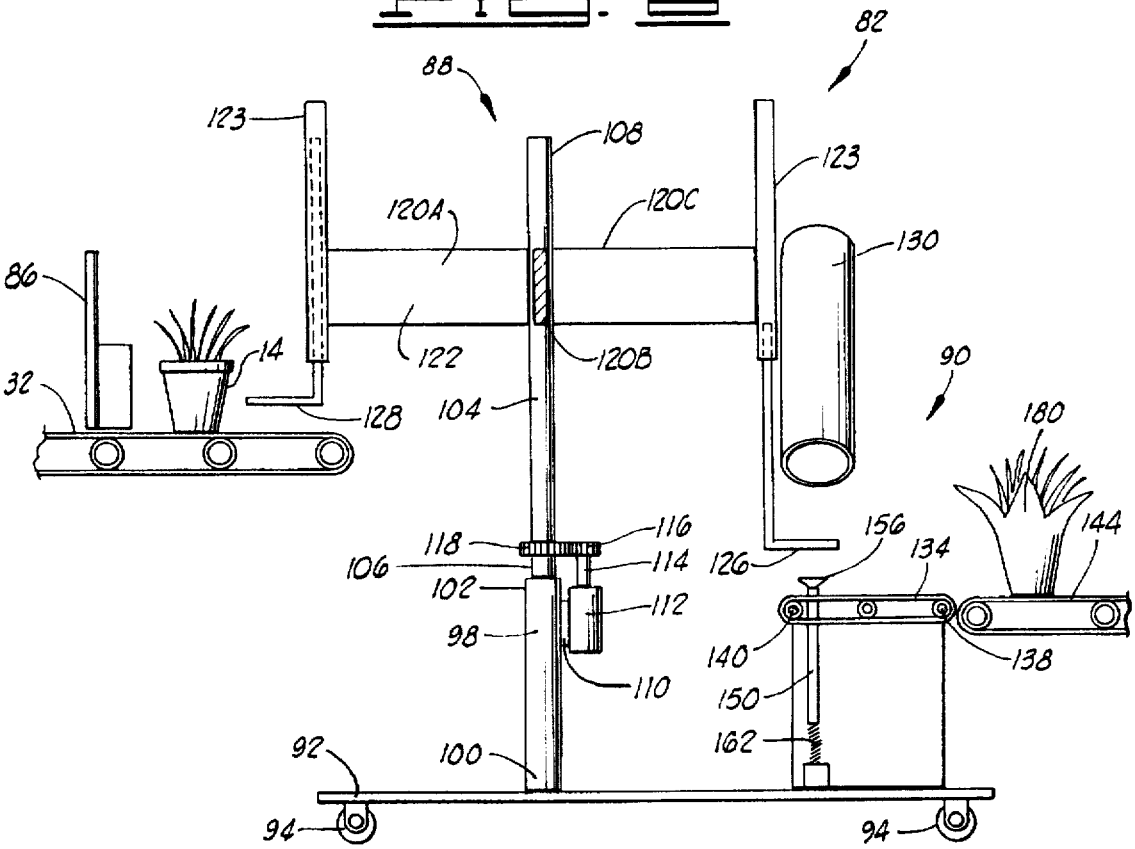
FIG. 7 is an elevational view of the cover placing station of FIG. 6.
Figure 8:
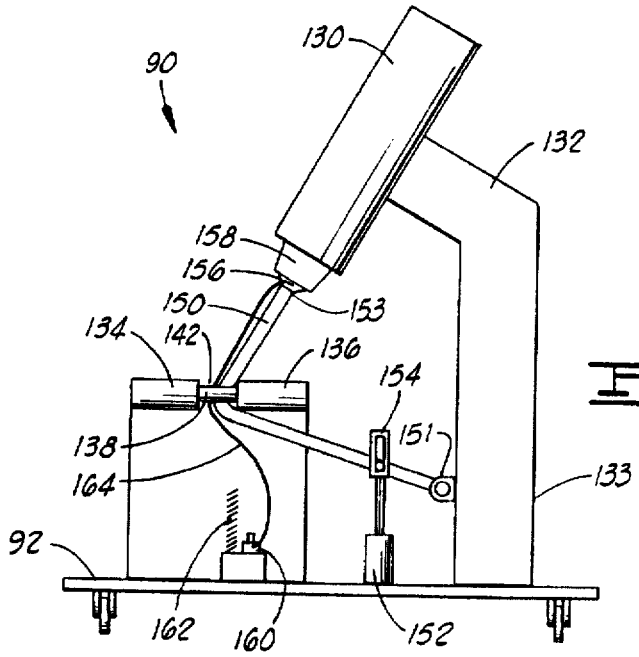
Figure 9:
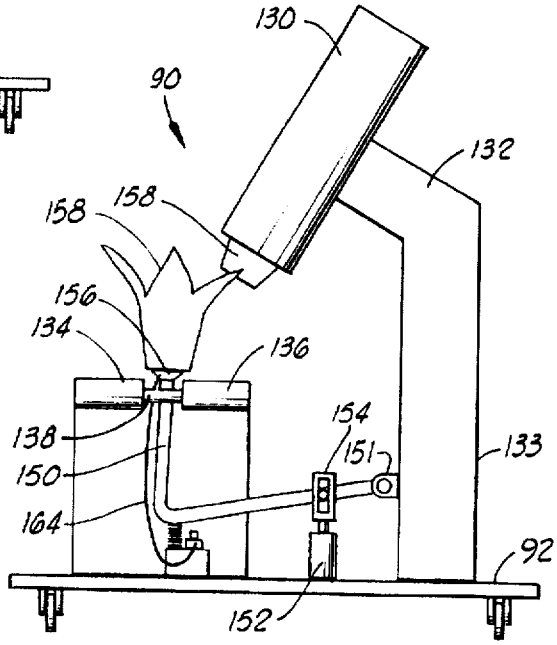
FIG. 9 is the cover placing sub-unit of FIG. 8 in position for receiving an article.
Figure 10:
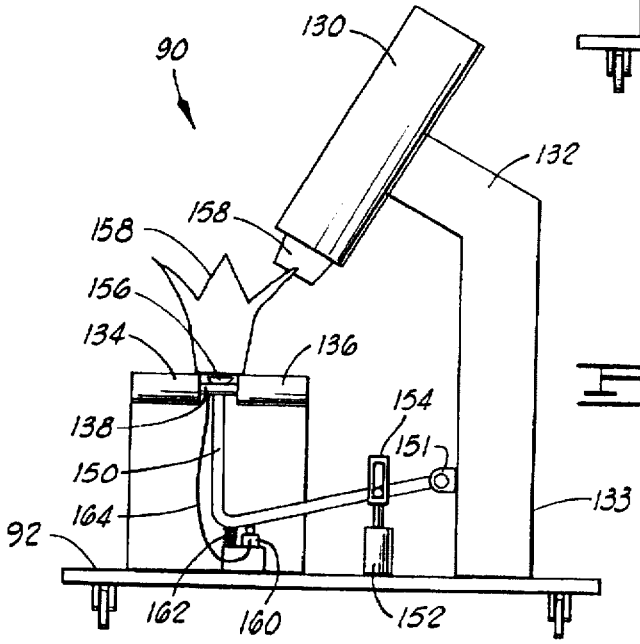
FIG. 10 is the cover placing sub-unit of FIG. 8 shown immediately after receiving an article.

Secured near the second end 108 of the turnstile axle 104 are four transfer assemblies 120A, 120B, 120C and 120D. Each transfer assembly 120A–120D includes a carrying unit 121, a brace 122, and a cylinder 123. The brace 122 has a first end 124 and a second end 125. Each carrying unit 121 comprises a first arm 126 and a second arm 128 (FIGS. 6–7).

The first end 124 of the brace 122 is secured to the turnstile axle 104 and is adapted for supporting a cylinder 123. The cylinder 123 is secured to the second end 125 of the brace 122.

Secured to the cylinder 123 are the first and second arms 126 and 128 of the carrying unit 121. The cylinder 123 is adapted to reciprocatingly raise and lower the carrying unit 121.

Referring now to FIGS. 6–10, also secured to the platform 92 is an automatic cover supplying assembly, also referred to as the cover denesting sub-unit 90. The cover denesting sub-unit 90 includes a cover dispenser housing 130 and a cover dispenser support 132 (FIGS. 8–10) having a base 133. The cover dispenser support 132 is adapted for supporting the cover dispenser housing 130 over the platform 92. The cover denesting sub-unit 90 also includes a conveyor with a first parallel belt 134 and a second parallel belt 136. The belts 134 and 136 are placed around rollers 138 and 140 (FIG. 7), and are spaced apart to provide a gap 142 lengthwise for enabling the placement of a retrieved cover into a potted plant application position.

A conveyor 144 having a first end 146 and a second end 148 is abutted at its first end 146 to the end of belts 134 and 136 in a position to receive a cover 158 or a covered potted plant from belts 134 and 136.

A suction support arm 150 is generally L shaped and is pivotally secured at a first end 151 near the base 133 of the cover dispenser support 132. The suction support arm 150 has a free end 153.

A cylinder 152 extends between the platform 92 and the suction support arm 150 and is slidingly secured to the suction support arm 150 by a bracket 154. The cylinder 152 and bracket 154 are adapted for raising the suction support arm 150 so the suction cup 156, which is connected to the free end 153 (FIG. 8) of the suction support arm 150, is raised to a position for removing a cover 158 (FIGS. 8–10) from the cover dispenser housing 130.

Secured to the platform 92 directly below the suction support arm 150 is a vacuum valve 160 and a spring 162. A vacuum line 164 extends from the suction cup 156 to the vacuum valve 160 and on to a vacuum source (not shown). Operational details of the cover denesting subunit 90 are described below in the In Operation section.

Figure 11:
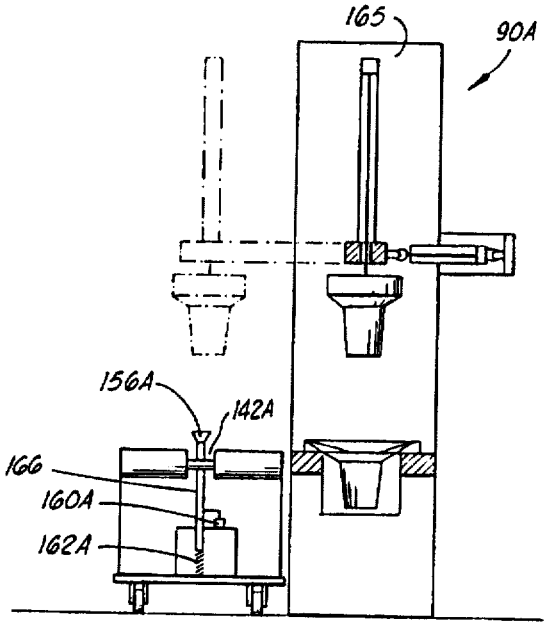
FIG. 11 is an elevational view of another embodiment for the cover placing sub-unit, constructed in accordance with the invention.
Figure 11A:
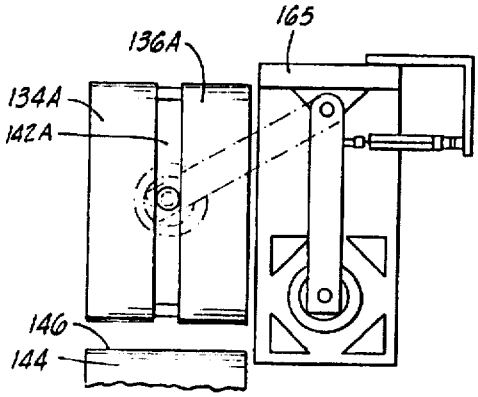
FIG. 11A is a plan view of the cover placing sub-unit shown in FIG. 11.

An alternate cover denesting sub-unit (automatic cover supplying assembly) embodiment, herein designated by the reference numeral 90A, is shown in FIG. 11. This embodiment uses an article forming system 165, such as is disclosed in U.S. Pat. No. 4,773,182, the specification of which is hereby incorporated specifically herein. The article forming system 165 places covers on a suction cup 156A. The suction cup 156A is supported by a rod 166 which extends up between a first parallel belt 134A and a second parallel belt 136A in a fashion similar to the suction support arm 150 described above. This embodiment also includes a vacuum valve 160A and a support spring 162A.

Figure 12:
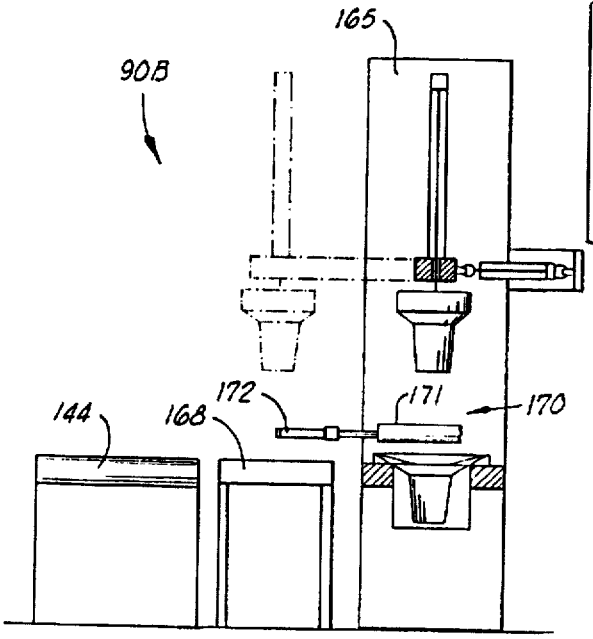
FIG. 12 is an elevational view of another embodiment for the cover placing sub-unit, constructed in accordance with the invention.
Figure 12A:
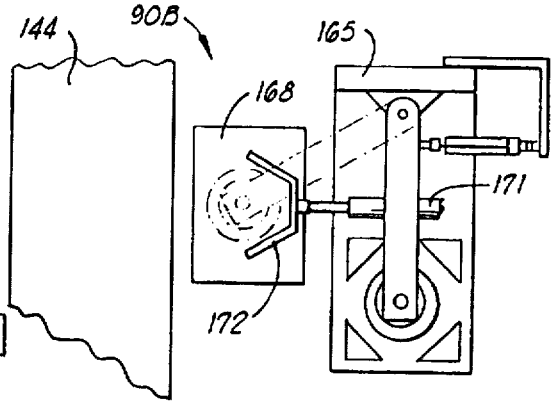
FIG. 12A is a plan view of the cover placing sub-unit shown in FIG. 12.

Another cover denesting sub-unit embodiment, herein designated by the reference numeral 90B, is shown in FIGS. 12 and 12A. In this embodiment the article processing system 165 places a cover (not shown) on a table 168, and a turnstile (not shown) then places a potted plant (not shown) into the cover (not shown). Alternatively, a potted plant may be placed manually within the cover. A pusher assembly 170 comprised of a cylinder 171 and a pushing arm 172 then pushes the covered potted plant (not shown) onto the conveyor 144.

Figure 13:
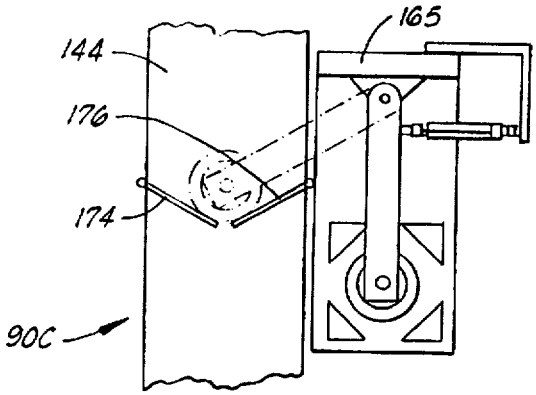
FIG. 13 is a plan view of yet another embodiment for the cover placing sub-unit, constructed in accordance with the invention.

Another cover denesting sub-unit embodiment, herein designated by the reference numeral 90C, is shown in FIG. 13. Sub-unit 90C uses a first gate 174 and a second gate 176 to hold a cover (not shown) stationary on the moving conveyor 144. Once the potted plant (not shown) is in the cover (not shown), gates 174 and 176 open, allowing the covered potted plant (not shown) to proceed down conveyor 144 for further processing.

At some point after the cover 158 has been denested and positioned, a potted plant is placed into the interior space of the cover 158 producing a covered potted plant 180. The potted plant may be placed into the cover 158 manually or automatically. The covered potted plant 180 is conveyed down conveyor 144 toward the second end 148 where it is transferred to an automatic sleeving station 184 for application of a sleeve about the covered potted plant 180 to form a sleeved covered potted plant.

Figure 17:
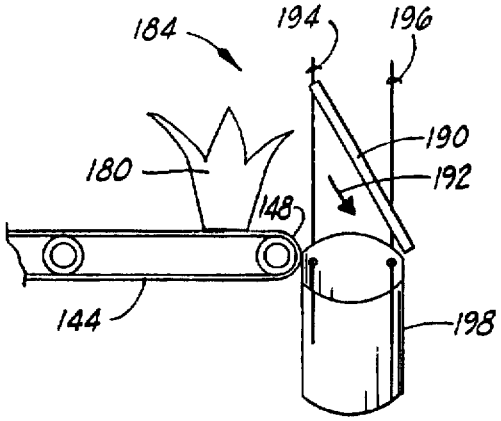
FIG. 17 is an elevational view of the sleeving station with parts removed for clarity.
Figure 18:
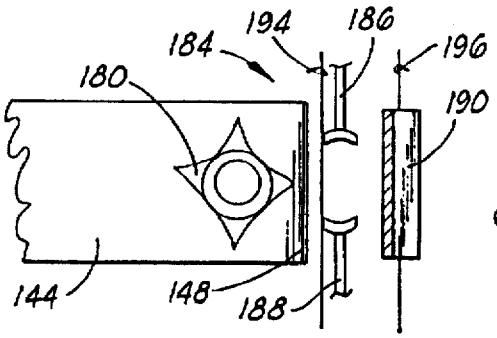
FIG. 18 is a plan view of the sleeving station.
Figure 19:
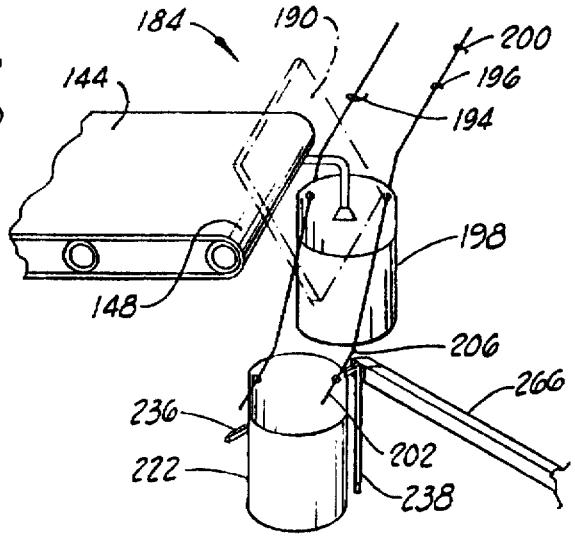
FIG. 19 is a perspective of the sleeving station and part of the sealing station.

Referring now to FIGS. 1 and 17–19, the sleeving station 184 includes a guiding assembly comprising a first spring loaded guide 186 and a second spring loaded guide 188. The spring loaded guides 186 and 188 (FIG. 18) receive a covered potted plant 180 as it moves from the second end 148 of conveyor 144. A brace 190 is secured above the spring loaded guides 186 and 188 to keep the potted plant 180 upright as it moves in direction 192 (FIG. 17) through the spring loaded guides 186 and 188. Below the guides 186 and 188 are a first wicket 194 and a second wicket 196 for holding a plurality of sleeves such as sleeve 198 (FIG. 16) and described in detail below. Each wicket 194 and 196 has a first end 200 and a second end 202 (FIG. 19). The first end 200 is secured to a brace (not shown) and extends downwardly at an angle to a point 206 between the first end 200 and the second end 202. From the point 206 to the second end 202, the wickets 194 and 196 extend horizontally or slightly downward.

Figure 14:
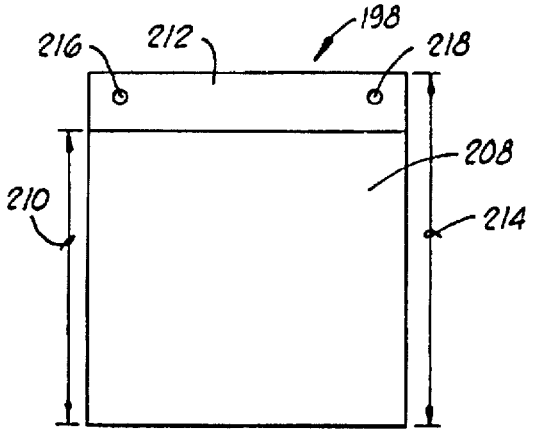
FIG. 14 is a view of a sleeve constructed in accordance with the invention.
Figure 15:
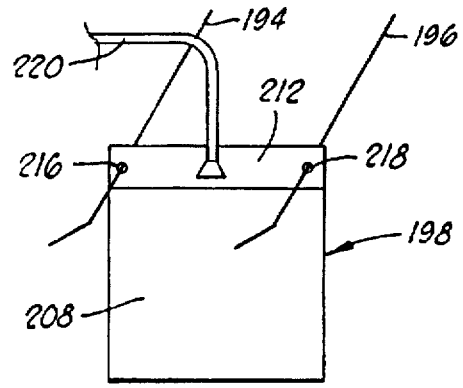
FIG. 15 is a perspective of part of a sleeving station showing a sleeve before the sleeve is inflated.
Figure 16:
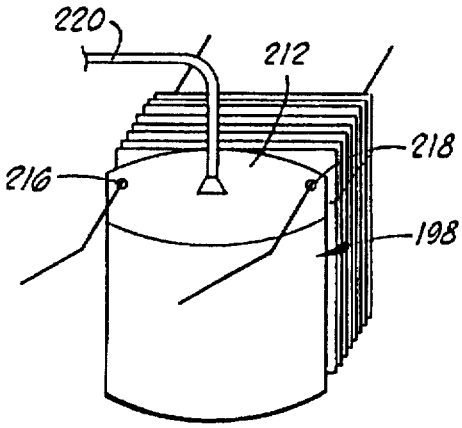
FIG. 16 is a perspective of part of the sleeving station showing an inflated sleeve.

As is shown in FIGS. 14–16, each sleeve 198 has a front side 208 having a height 210, and a back side 212 having a height 214. The height 210 of the front side 208 of the sleeve 198 is less than the height 214 of the back side 212 of the sleeve 198. Holes 216 and 218 are formed in the upper corners of the back side 212 of each sleeve 198. Although sleeve 198 is shown in FIGS. 14–17 as tubular, the shape of sleeve 198 may be any variety of shapes but the preferred embodiment is frusto-conical. Additionally, in an alternative embodiment, heights 210 and 214 may be the same and holes 216 and 218 may extend through both sides 208 and 212.

Referring now in particular to FIGS. 15 and 16, the wickets 194 and 196 extend through the holes 216 and 218, respectively, to support the sleeve 198. The wickets 194 and 196 are secured so the sleeve 198 is pulled by gravity down the wickets 194 and 196 until the backside 212 of the sleeve 198 comes into contact with an automatic sleeve opening assembly comprising an inflator tube 220 (FIG. 16). Air exiting the inflator tube 220 opens and inflates the sleeve 198.

In an alternative embodiment of the sleeve opening assembly, suction cups (not shown) may be employed to pull open the side 208 of the sleeve 198 to allow the air blast from the inflator tube 220 and to more easily access and open the sleeve 198.

As the covered potted plant 180 reaches the end 148 of the conveyor 144 and moves in direction 192 through the chute between the guides 186 and 188 and the brace 190, it is deposited into an open sleeve 198 (FIG. 19) to provide a sleeved potted plant 222 (also referred to in this instance as a sleeved covered potted plant).

In an alternative embodiment (not shown), the covered potted plant 180 may be formed into a sleeved covered potted plant 222 by wrapping a sheet of sleeving material (not shown) about the covered potted plant automatically.

Figure 20:
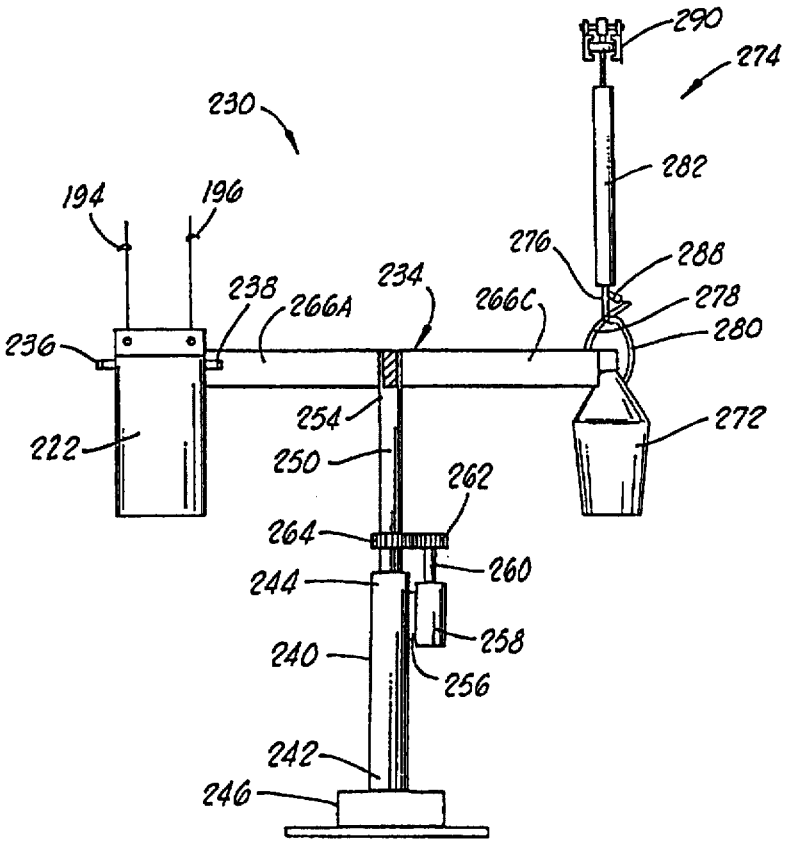
FIG. 20 is an elevational view showing a sealing and a placing station constructed in accordance with the invention.

Referring now to FIGS. 1 and 20, a gripping station 230, also referred to as a transfer station, is positioned to remove a sleeved potted plant 222 from the wickets 194 and 196. The gripping station 230 comprises a turnstile 234 and a first gripping arm 236 and a second gripping arm 238. The turnstile 234 further comprises a conduit 240 with a first end 242 and a second end 244. The first end 242 is secured to a base 246. The second end 244 of the conduit 240 is open for accepting a first end (not shown) of a turnstile axle 250. The turnstile axle 250 has a first end (placed inside the conduit) and a second end 254. The diameter of the turnstile axle 250 is slightly smaller than the diameter of the opening in the conduit 240. This allows the turnstile axle 250 to rotate freely within the conduit 240.

A drive assembly bracket 256 is secured near the second end 244 of the conduit 240. Secured to the drive assembly bracket 256 is a drive assembly 258 such as a motor. The drive assembly 258 has a rotatable shaft 260. Secured to the rotatable shaft 260 is a first gear 262. A second gear 264 is secured to the turnstile axle 250 in a position such that the teeth on the first gear 262 mesh with teeth of the second gear 264.

Secured to the second end 254 of the turnstile axle 250 are support arms 266A, 266B, 266C and 266D. Each support arm 266A–266D comprises a first gripping arm 236 and a second gripping arm 238. Connected to each support arm 266A–266D is a cylinder 270 adapted for closing the first gripping arm 236 and the second gripping arm 238 together against the upper end of the sleeve 198 of the sleeved potted plant 222.

Figure 21:
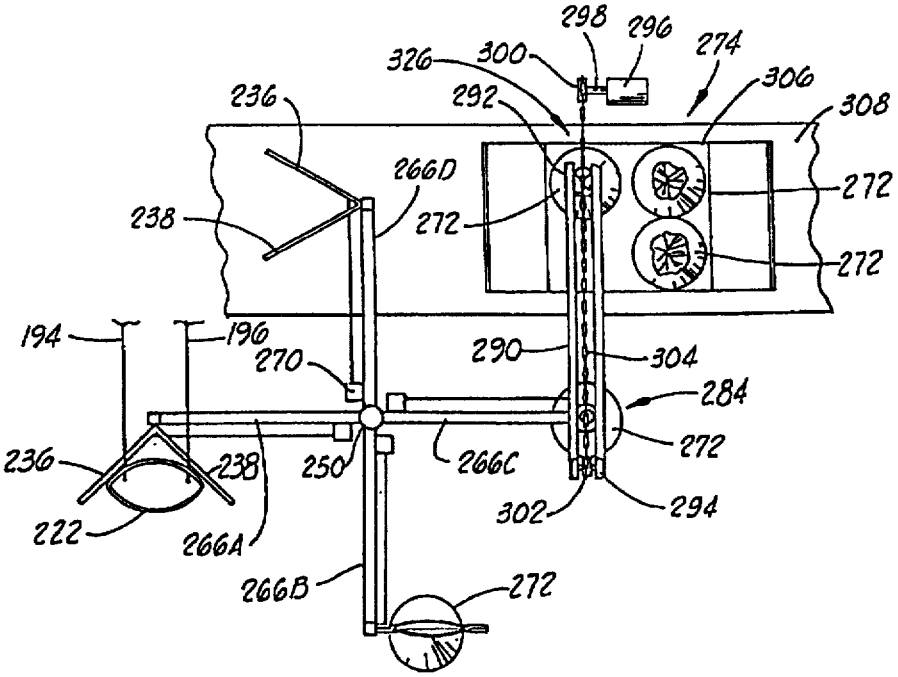
FIG. 21 is a plan view showing the sealing and placing station of FIG. 19.

In an alternative embodiment, the first gripping arm 236 includes a heating element (not shown) adapted to seal the upper position of the sleeve 198 of the sleeved potted plant 222 when the upper end is compressed between the gripping arms 236 and 238 thereby forming a sealed sleeved potted plant 272. The sealing arms 236 and 238 grasp the sealed sleeved potted plant 272 thereby freeing the sealed sleeved potted plant 272 from the guide wickets 194 and 196. From there, the support arm 266 carries the sealed sleeved potted plant 272 to a placing station 274 (FIGS. 1, 20–21). The upper portion of the sleeve 198 may alternately be sealed by gripping arms 236 and 238 which comprise sonic elements, vibratory elements or pressure-sensitive elements.

Positioned to receive a sleeved potted plant 222 or a sealed sleeved potted plant 272 is a placing station 274 (FIGS. 20–21). The placing station 274 comprises a lowering arm 276, and a first pinching arm 278 and a second pinching arm 280, and a cylinder 282.

The lowering arm 276 is reciprocatingly secured to the cylinder 282 such that the lowering arm 276 may be reciprocatingly lowered and raised. The first pinching arm 278 is pivotally secured opposite the pinching arm 280 of the lowering arm 276. The pinching arms 278 and 280 first receive the article 272 or 222 at receiving position 284 (FIG. 21). A small cylinder 288 is secured between the lowering arm 276 and the pinching arm 278. The cylinder 288 is adapted to allow the pinching arms 278 and 280 to grasp and release the sealed sleeved pot 272 or the sleeved potted plant 222.

The cylinder 282 is suspended from a rail 290. The rail 290 has a first end 292 and a second end 294. Secured to the first end 292 is a motor 296 with rotatable shaft 298. Secured to the rotatable shaft 298 is a sprocket 300. On the second end 294 of the rail 290 is an idler sprocket 302. A continuous loop of chain 304 extends around the first sprocket 300 and the second sprocket 302. The cylinder 282 is secured to the chain 304, thus, by rotating the shaft 298, the cylinder 282 is moved along the rail 290 to a predetermined position for lowering the grasped sleeved potted plant 222 or the sealed sleeved potted plant 272 into a box or carton 306.

A carton placing conveyor 308 is adapted to move the carton 306 into position for receiving potted plants 222 or 272. Once the carton 306 is full the conveyor 308 removes the carton 306 from the packing area. Cartons, like carton 306, are supplied from carton folding station 310 (FIG. 1). Many commercially available carton folders are suitable, and therefore, need not be described herein. Alternatively, cartons 306 may be supplied manually.

In Operation

Figure 3:
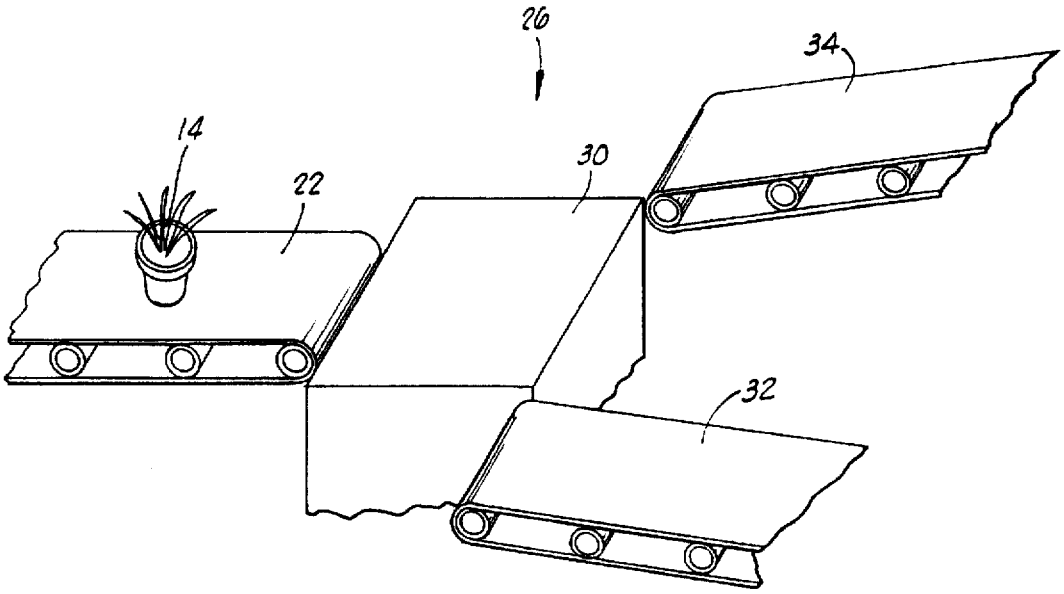
FIG. 3 is a perspective view of a manual sorting station which may be used in the article packaging system.

Articles 14, which may be potted plants as shown, for example in FIG. 3, are placed on conveyor 22, then are moved to a sorting station 24 (FIG. 1). If the sorting station 24 is a manual sorting station 26 such as shown in FIG. 3, an operator (not shown) will select articles 14 to be packaged together, and place them on a conveyor 32 or 34 which will carry them to the next station.

If the sorting station 24 is the automatic sorting station 28 such as shown in FIG. 4, the articles 14 will travel down conveyor 22 until they come in contact with positioning gates 36 and 38. The positioning gates 36 and 38 will hold an article 14 until a predetermined distance 316 between it and the previous article **14*a* has been achieved. Once the distance 316 between the article 14 and the previous article 14*a* has been achieved, positioning gates 36 and 38 will open allowing the article 14 to proceed on to the light sensor 42**.

Since the positioning gates 36 and 38 open simultaneously, the article 14 will be centered on the conveyor 22, and thus, all articles 14 will be the same distance from the light sensor assembly 42 as they pass in front of it. As the article 14 passes in front of the light sensor assembly 42 the article 14 comes into contact with and moves a light switch 45. Movement of the light switch 45 activates the light source 66 in the housing 62.

Light leaving the housing 62 through slot 64 will be partially absorbed and partially reflected by the article 14. Thus, the larger and more dense the article 14, the less light will reach the photoelectric cell 43. In this way smaller or less dense articles 14 may be distinguished from larger or denser articles 14. If the article 14 is small the gate 46 will swing into the first position 68 and if the article 14 is large the gate 46 will swing into the second position 70 as determined by a control assembly (not shown). As the article 14 comes into contact with gate 46 it is directed to one side of the positioning bar 72. The positioning bar 72 further directs the article 14 onto an adjacent conveyor such as conveyor 32. Alternately, the article 14 may be sorted after a decorative cover has been applied.

If the article 14 is to receive a decorative cover, which in the case of a potted plant would be a flower pot cover, the covering station 82 will be positioned at the end of conveyor 32. The article covering station 82 is mounted on a platform 92 with locking casters 94. Thus, if no covering is required the covering station 82 may simply be rolled to the side and a section of conveyor (not shown) may take its place. Assuming that covering is desired, any of the several embodiments may be used with ease.

In the preferred operational embodiment, the article 14 will first encounter the gates 84 and 86 (FIGS. 6–7). The gates 84 and 86 hold the article 14 until the turnstile 88 is in position to accept the article 14, that is, when transfer assembly 120A is in line with conveyor 32. As soon as the article 14 has entered the arms 126 and 128, of the carrying unit 121, the carrying unit 121 is raised by cylinder 123 and the turnstile 88 begins to turn in a counterclockwise direction 318 (FIG. 6).

Figure 8:
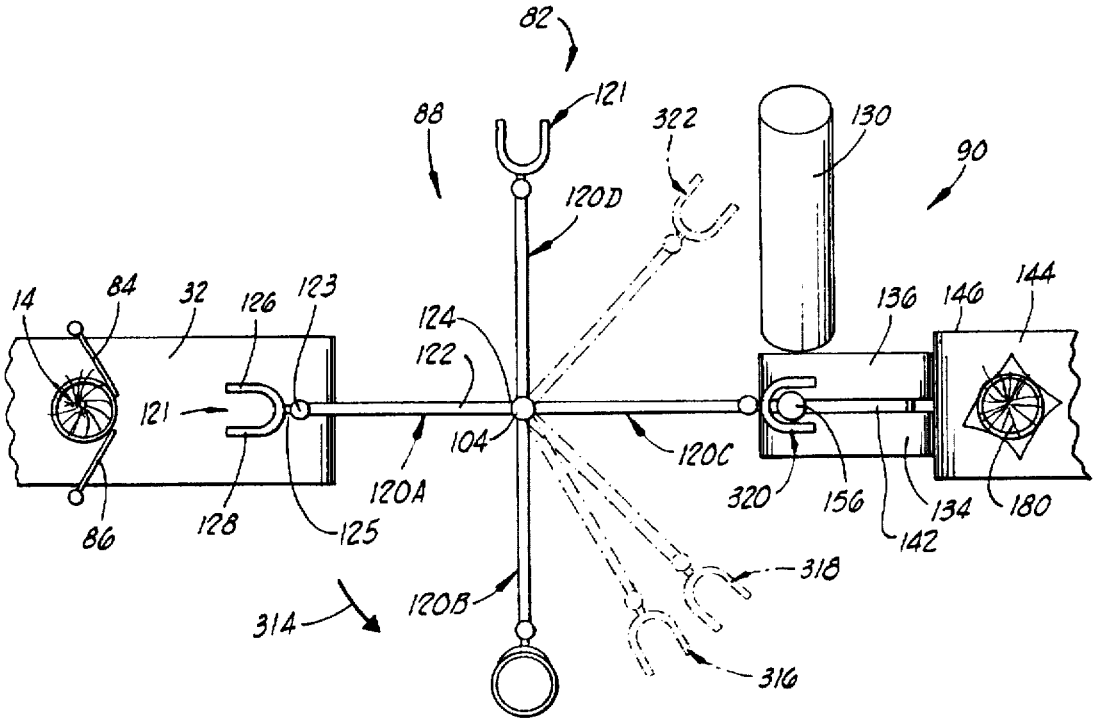
FIG. 8 is an enlarged elevation of a cover placing sub-unit, in position to retrieve a cover.

When the transfer assembly 120A is in position 316 (FIG. 6) the suction support arm 150 is raised by the cylinder 152 (see FIG. 8). By the time the transfer assembly 120A has reached position 318, arm 150 has been lowered by cylinder 152 suctionly bringing with it a cover 158 from cover dispensing housing 130 (see FIG. 9). When transfer assembly 120A reaches position 320 (FIG. 6) the turnstile 88 momentarily stops over the cover 158 while the cylinder 124 lowers the carrying unit 121 thereby lowering the article 14 into the cover 158. The weight of the article 14 and cover 158 depresses spring 162 thus lowering the covered article 180 onto conveyor belts 134 and 136 (see FIG. 10).

As spring 162 is depressed, the vacuum valve 160 is deactivated thereby causing the suction cup 156 to release the cover 158 and allowing the covered article 180 to rest upon the conveyor belts 134 and 136. The conveyor belts 134 and 136 direct the covered article 180 toward conveyor 182 (FIG. 7), and thus out of the carrying unit 121. As the turnstile 88 resumes rotation, and as transfer assembly 120A passes through position 322 (FIG. 6), cylinder 124 retracts the carrying unit 121 thereby raising the first arm 126 and the second arm 128 into position for receiving the next article 14 from conveyor 32.

The covered article 180 is directed from belts 134 and 136 to conveyor 144 (FIG. 7), and continues to the sleeving station 184 (FIG. 17). As the article reaches the second end 148 of conveyor 144 it drops gravitationally through a pair of spring loaded guides 186 and 188 (FIG. 18). A brace 190 supports the upper side of the covered article 180 as it drops from the conveyor 182 thereby maintaining the vertical positioning of the covered article 180 as it drops. The spring loaded guides, 186 and 188, guide the covered article 180 into an opened sleeve 198 (FIG. 19).

As is shown in FIG. 16, a supply of sleeves 198 is supported on wickets 194 and 196, and are gravitationally fed to the inflator tube 220. The end of the inflator tube 220 comes into contact with the back side 212 (FIG. 16) of the first sleeve 198 in the supply, thus keeping the supply of sleeves 198 from sliding down the wickets 194 and 196. Air exiting from the inflator tube 220 inflates the lower most sleeve 198 in preparation for receiving a covered article 180. The added weight of the covered article 180 dropping from the conveyor 182 causes the opened sleeve 198 to sag thus releasing it from the inflator tube 220 and enabling it to slide down wickets 194 and 196 to the horizontal section of the wickets 194 and 196 (FIG. 19). After the first sleeve 198 is removed another sleeve 198 moves into position to be inflated. The first sleeve 198 containing the covered article 180, now constituting a sleeved covered article 222 is grasped by gripping arms 236 and 238 (FIG. 19) of the gripping (transfer) station 230 (FIGS. 20 and 21).

The turnstile 234 then rotates, thus pulling the sleeve from the wicket 194 and 196. In one embodiment, as the turnstile 234 continues to rotate, heating elements (not shown) in gripping arm 236 heat the gripped portions of the sleeve 198 sealing the front and the back sides, 208 and 212, of the sleeve 198 of the sleeved covered article 222 (FIG. 21) to form the sealed sleeved covered article 272. In one version, the sleeve 198 is not sealed over the sleeved covered article 222. As the turnstile 234 rotates 180 degrees to a position 284, the gripping arms 236 and 238, still carrying the unsealed article 222 or the sealed article 272 (as the case may be), move between the pinching arm 278 and the pinching arm 280 of the placing station 274 (FIGS. 20–21).

Once the gripping arms 236 and 238 are between the pinching arm 278 and pinching arm 280, the pinching arms 278 and 280 close to pinch the sleeve of the sleeved covered article 222 or of the sealed sleeved covered article 272 (as the case may be) and the sealing arms 236 and 238 are opened slightly, thus the article 222 or 272 is now held by the pinching arms 278 and 280 of the placing station 274. Immediately thereafter the cylinder 282 is pulled along a rail 290 via motor 296 and chain 304 (FIGS. 20–21) from position 284 to position 326 and the article 222 or 272 is lowered into carton 306. The pinching arms 278 and 280 are then released and the lifting arm 276 is raised and returned to position 284 to accept the next article 222 or 272.

Each article 222 or 272 is received and placed in the carton 306. Placing of the article 222 or 272 in the carton 306 may be manually or automatically controlled (control means not shown). The conveyor 308 moves as necessary to allow placing of the articles 222 or 272 in the carton 306.

This cycle repeats until the carton 306 is full. At that time conveyor 308 carries away the full carton 306 and replaces it with a new container 306. The full carton 306 eventually reaches the carton closing station 330 (FIG. 1) and then the carton labeling station 332 (FIG. 1) where machines of construction well known to those of ordinary skill in the art close and label the carton 306. The carton 306 is then ready for shipment.

EMBODIMENTS OF FIGS. 22–34

Figures 22, 23:
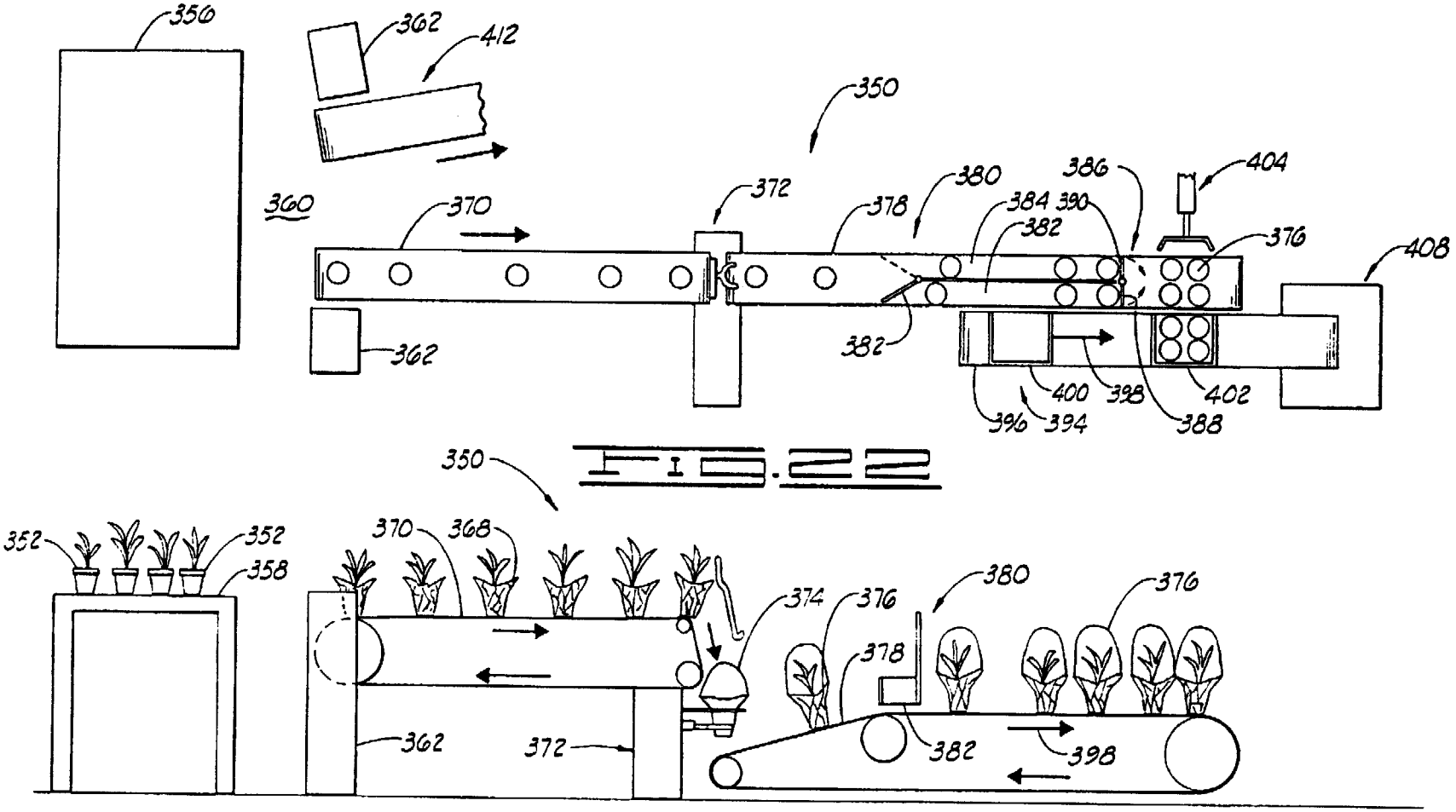
FIG. 22 is a schematic of another embodiment of an article packaging system which is constructed in accordance with the present invention.
FIG. 23 is a side view of the packaging system of FIG. 22.

Attention is now directed to the article packaging system designated by the reference numeral 350 and represented in FIGS. 22 and 23. The packaging system 350 is a processing line for sorting articles, for example in this case potted plants 352, according to size, quality, or other criteria and then for processing and packaging the processed plants. The system 350 would automatically place a covered potted plant into a protective sleeve and would then place the sleeved pot into a box or carton for shipping and distribution.

In overview, the article packaging system 350 comprises a service station 356 having a platform or table 358 serving to support a set of unsorted potted plants 352. A sorting station 360 employs a sorter which inspects the potted plants 352 and sorts them in accordance with predetermined criteria such as size, quality or variety or any number of other criteria. The sorting station 360 may be manually operated like the sorting station 26 described herein or it may operate automatically, for example, like the automatic sorting station 28 described herein.

A cover supplying station 362 comprises an automatic cover supplying assembly 364 for selecting a pot cover 366 and placing the pot cover 366 in an application position for receiving a potted plant 352 thereby forming a covered potted plant 368. The covered potted plant 368 is then placed on a conveyor 370.

A sleeving station 372 constructed much the same as sleeving station 184 described herein is downstream of the conveyor 370 and comprises an apparatus for applying a protective sleeve 374 to the covered potted plant 368 to form a sleeved covered potted plant 376. The sleeved covered potted plant 376 is placed onto a conveyor 378 for further processing. A gate station 380 is a gate 382 which serves to divert the sleeved covered potted plants 376 to a separate first lane 382 and a separate second lane 384 of the conveyor 378 in preparation for being placed in a carton. A gathering station 386 is a first gate 388 and a second gate 390 for stopping and accumulating the sleeved plants 376 in preparation for boxing. In an alternative embodiment either the gate station 380 or the gathering station 386, or both stations 380 and 386, are optional.

A carton feeding station 394 comprises a conveyor 396 for conveying or feeding in direction 398 boxes or cartons 400 which will receive the sleeved plants 376. A boxing station 404 pushes or conveys, the sleeved plants 376 into an empty carton 400 for shipping. A closing station 408, if present, serves to close and secure by taping, gluing or stapling each full carton 402 in preparation for shipping. The closing station 408 could be automatic or could be manually operated. All stations from the cover supplying station 362 to, the closing station 408, inclusive, comprise a single processing stream of the packaging system 350. The packaging system 350 may comprise a second processing stream 396 for processing other potted plants sorted at the second station 360.

EMBODIMENTS OF COVER SUPPLYING STATIONS

Figure 28A:
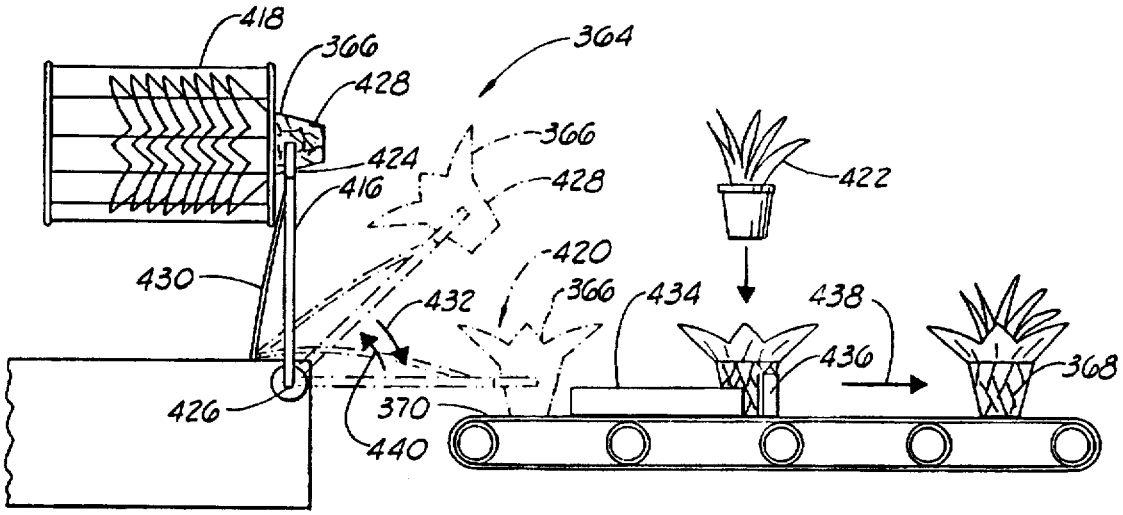
FIG. 28A is an elevational view of a cover supplying device which may be used in an article packaging system.
Figure 28B:
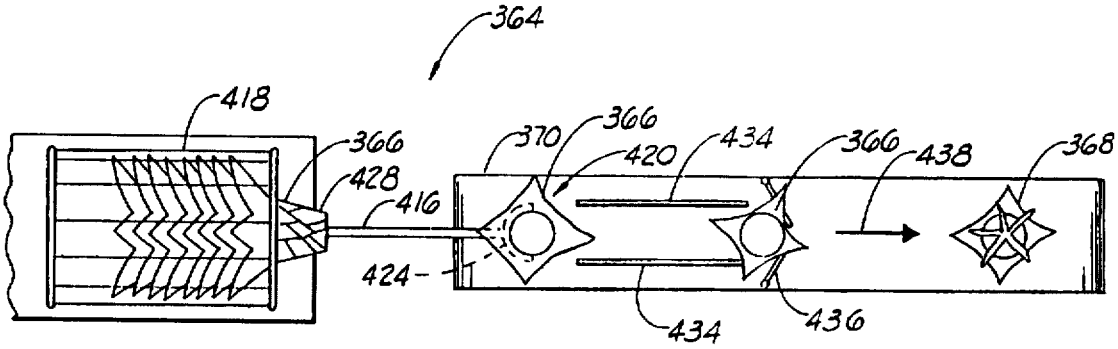
FIG. 28B is a plan view of the cover supplying device of FIG. 28A.
Figure 23A:
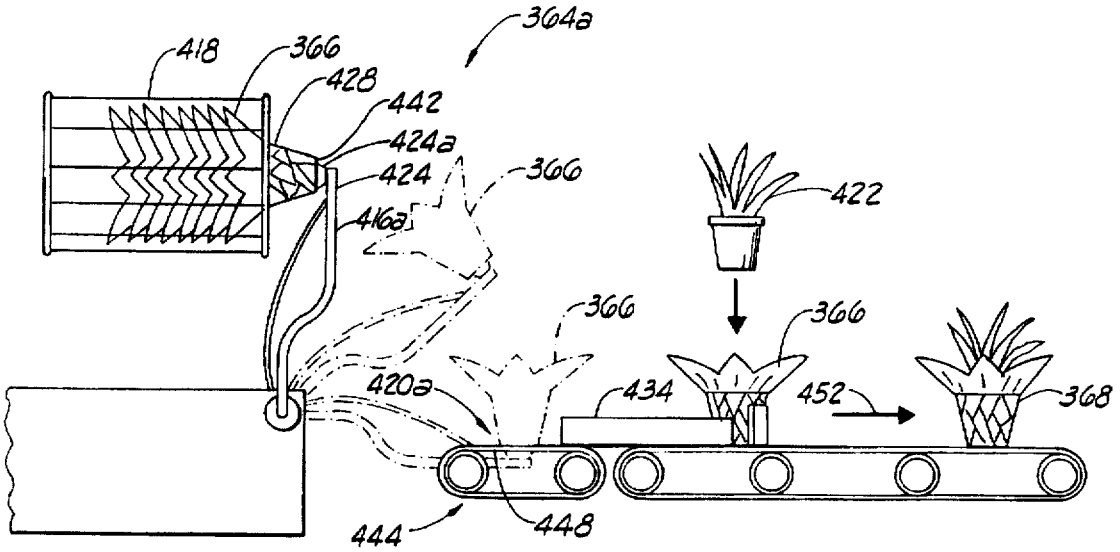
Figure 23B:
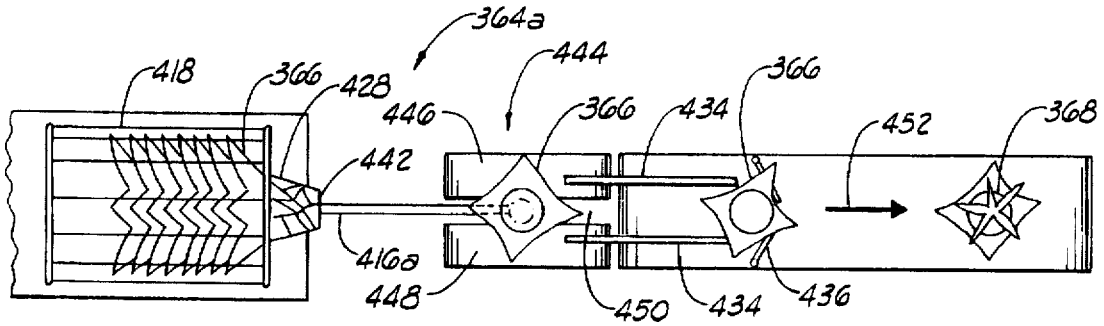

Turning now to FIGS. 28A–28B, the apparatus comprising the cover supplying station 362 is described in more detail. The cover supplying assembly 364 is an apparatus having a denesting arm 416 for denesting a pot cover 366 from a bin 418 and transferring the pot cover 366 to a receiving position 420 for receiving a potted plant 422. The denesting arm 416 has a grasping end 424 and a pivoting end 426. The grasping end 424 has a shape adapted to fit around the base 428 of a pot cover 366 resting in a bin 418 of pot covers 366. The grasping end 424 grasps the base 428 of the pot cover 366, in the preferred embodiment by a suctioning mechanism 430 and disengages the pot cover 366 from the bin 418 of pot covers 366. The arm 416, now carrying a pot cover 366, pivots in direction 432 to a position over a conveyor. The suction from the suctioning mechanism 430 is removed, thereby releasing the pot cover 366 and placing the pot cover 366 on the conveyor 370 in preparation for receiving a potted plant 422. The conveyor 370 may be equipped with guide walls 434 to guide the pot cover to a gate 436 to restrain the pot cover in a stationary position. At this position, a pot is disposed within the pot cover 366 to form a covered potted plant 368.

The gate 436 is opened. The covered potted plant 368 is released therefrom and travels in direction 438 down the conveyor 370 to the next station. Meanwhile, the denesting arm 416 is pivoted away in direction 440 and is returned to a position to retrieve the next pot cover 366.

Another denesting embodiment of the cover supplying station 362, illustrated in FIGS. 29A–29B, comprises a cover supplying assembly **364*a* having a denesting arm 416*a* for denesting from a bin 418 and transferring the pot cover 366 to a receiving position 420*a* for receiving a potted plant 422. In this embodiment the grasping end 424 of the arm 416*a* comprises a suction cup 424*a* which places a suction on the outer bottom 442 of the base 428 of the pot cover 366. The denesting arm 416*a* pivots away from the bin 418, and the pot cover 366 is removed from the bin 418 and carried to a conveyor assembly 444**.

The conveyor assembly 444 comprises a first parallel belt 446 and a second parallel belt 448 having a gap extending lengthwise therebetween. The grasping end 424 with the suction cup **424*a* is disposed in the gap 450 between the parallel belts 446 and 448 of the conveyor assembly 444. As the bottom 442 of the pot cover 366 approaches the conveyor assembly 444, the suction from the suction cup 424*a* is released and, as the grasping arm 424 continues its downward motion, the pot cover 366 is rested gently on the conveyor assembly 444 and is carried by the belts 446 and 448 in direction 452 through the guide walls 434 to a gate 436**.

At gate 436, the pot cover 366 is held stationary while a potted plant 422 is disposed manually or automatically, within the pot cover 366, thereby providing a covered potted plant 368. The denesting arm **416*a* is then available to retrieve another pot cover 366. The cover supplying assemblies 364 and 364*a* may be equipped with sensors (not shown) to regulate and control the operation of the denesting arms 416 and 416*a* and of the conveyor assemblies 370 and 444 and gates 436**.

EMBODIMENTS OF SLEEVING STATIONS

Figure 24A:
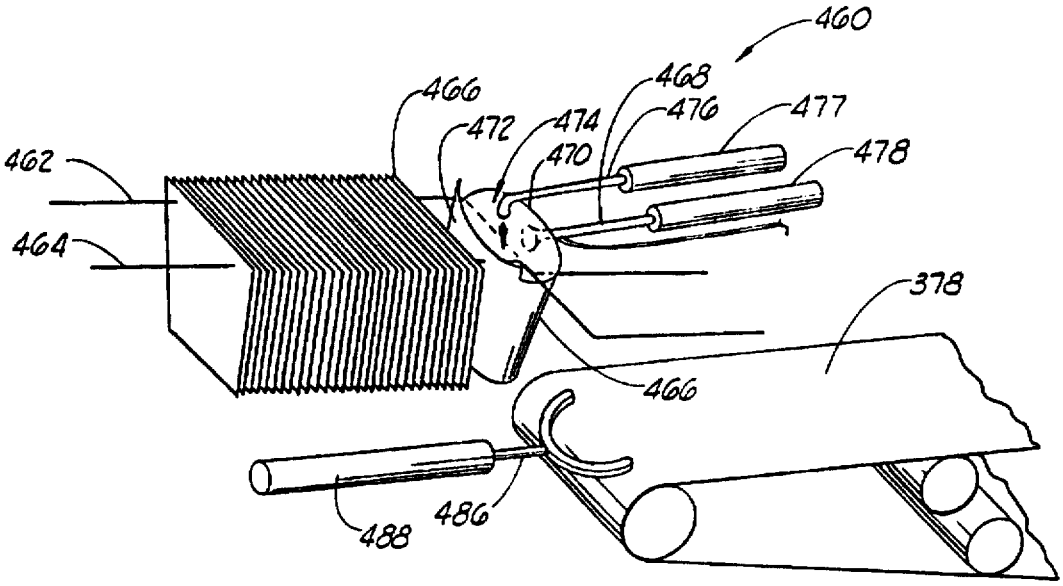
FIG. 24A is an elevational view of a sleeving station which may be used in an article packaging system.

Turning now to FIGS. 24A–D, the sleeving apparatus 460 of the sleeving station 372 will be described. The sleeving apparatus 460 comprises a sleeve support assembly comprising a first wicket 462 and a second wicket 464 which bear a set of sleeves 466. The sleeving apparatus 460 is the same as the sleeving station 484 described herein except for the modifications described herein. Each wicket 462 and 464 extends horizontally for a distance, then bends downward diagonally. The sleeving apparatus 460 further comprises a suctioning tube 468 which applies a suction to a first side 470 of a sleeve 466 for loosening and separating the first side 470 from the second side 472 of the sleeve 466 to provide an opening 474 at the upper end of the sleeve 466 (FIG. 24A).

Figure 24B:
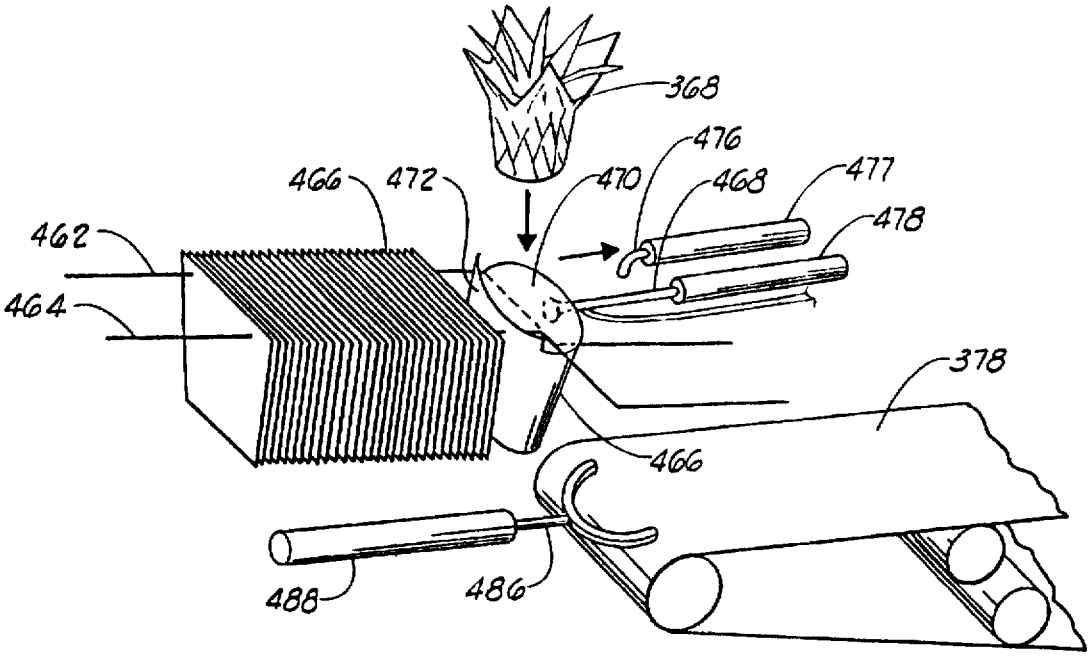
FIG. 24B is a view of the sleeving station of FIG. 24A indicating a sleeve positioned to receive a potted plant.

Air is forced into the opening 474 of the sleeve 466 from an inflator tube 476 and the sleeve 466 is thereby sufficiently inflated to receive a potted plant. The inflator tube is retracted in direction by an inflator cylinder or by another retracting device (FIG. 24B). A covered potted plant 368 is then deposited into the open sleeve 466. The covered potted plant 368 may be automatically deposited to the sleeve 466 via a mechanism similar to that described by FIGS. 17–18 above for the sleeving station 184 described previously. Alternatively, the covered potted plant 368 may be deposited into the sleeve 466 manually by an operator. Alternatively, a potted plant 422 without a cover 366 may be inserted into the sleeve 466, thereby bypassing the cover supplying assembly 364.

Figure 24C:
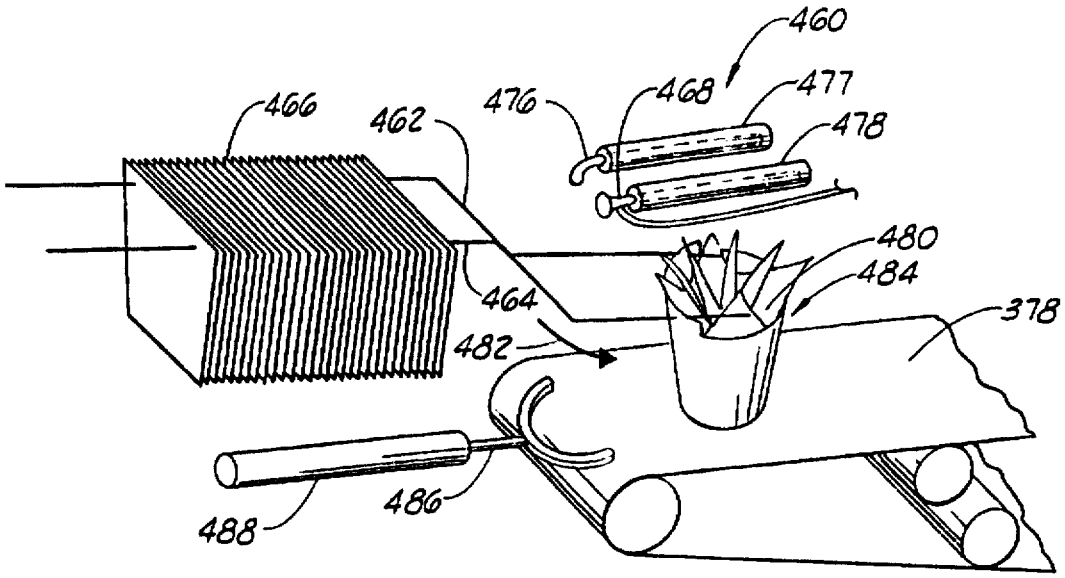
FIG. 24C is a view of the sleeving station of FIG. 24A after a potted plant has been inserted into a sleeve.

The suction tube 468 is then retracted into the suction cylinder 478. The resulting sleeved covered potted plant 480 will then slide via gravity down the wickets 462 and 464 in direction 482 to a position 484 over the conveyor 378 (FIG. 24C). The sleeved potted plant 480 may slide onto the conveyor 378 and, by the friction of the conveyor 378 underneath the bottom 442 of the base 428 of the sleeved potted plant 480, be carried by the conveyor 378 away from the sleeving station 372.

Figure 24D:
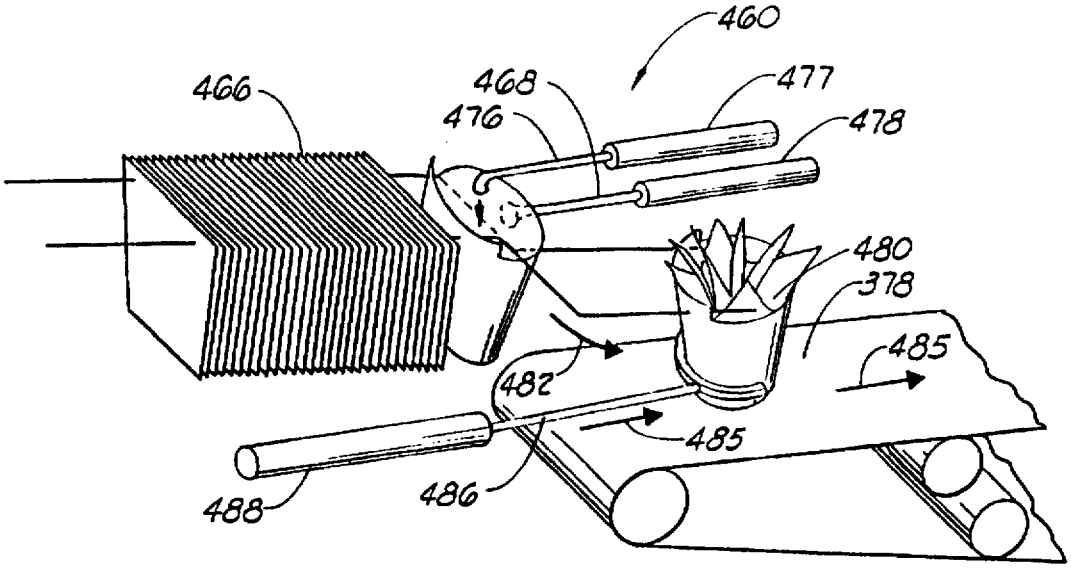
FIG. 24D is a view of the sleeving station of FIG. 24A showing a sleeved potted plant pushed onto a conveyor.

Alternatively, the sleeving station apparatus 460 may be equipped with a disengaging assembly comprising an extendable pushing arm 486 to push the sleeved potted plant 480 in direction 485 off the wickets 462 and 464 onto the conveyor 378 (FIG. 24D). The sleeved potted plant 480 is thereby conveyed upon the conveyor 378 downstream and is ultimately packed into a carton 400. The extendable pushing arm 486 is then retracted by a pushing arm cylinder 488 in preparation for the next sleeved potted plant 480. Operation of the sleeving station 372 may be regulated by sensing devices (not shown) opening the sleeve 466 in preparation for depositing a potted plant therein and for maintaining an even and regulated flow of sleeved potted plants 480 on the conveyor 378.

The components of the sleeving apparatus embodiments are illustrated in FIGS. 15–19 and 24A–27B as isolated.

However, it will be appreciated and understood by one skilled in the art that the components could be easily and completely attached and assembled together to form a unified apparatus.

EMBODIMENTS OF THE BOXING STATIONS

Figure 25:
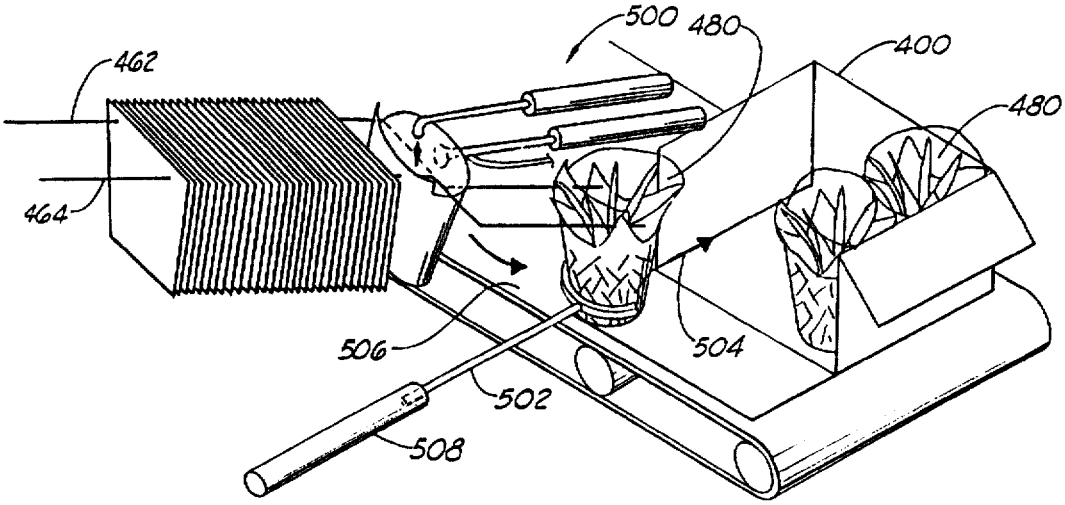
FIG. 25 is an elevational view of a sleeving station modified to push sleeved potted plants directly into a box.
Figure 26:
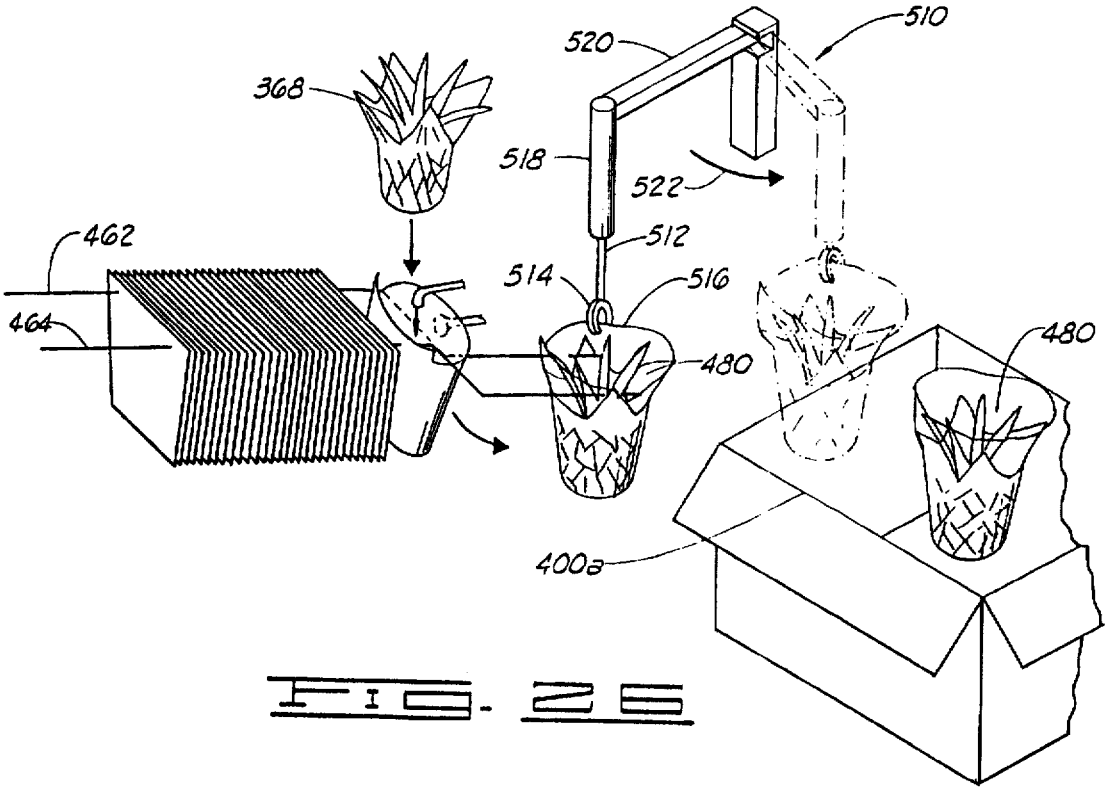
FIG. 26 is an elevational view of a sleeving station modified to transfer a sleeved potted plant by lifting it into a box.

Referring now to FIGS. 25–26, the sleeved potted plants 480 may be boxed at a boxing station 404 immediately after leaving the sleeving station 372. In one embodiment, the boxing station 404 comprises a boxing assembly 500 and an extendable automatic pushing arm 502 which, while pushing the sleeved potted plant 480 off the wickets 462 and 464, proceeds to push the sleeved potted plant 480 in direction 504 into an open-sided box or carton 400 resting on an adjacent conveying system 506 (FIG. 25). Once the carton 400 is filled, the filled carton 402 is passed to the closing station 408 for closing and securing. The pushing arm 502 is retracted by a retracting cylinder 508 in preparation for another sleeved potted plant 480.

In another embodiment of the boxing station 404, a boxing assembly 510 has a pivotable automatic gripping arm 512 having a gripping end 514 (FIG. 26). The gripping end 514 of the gripping arm 512 grips an upper portion 516 of the sleeved potted plant 480. The gripping arm 512 is retractable by a cylinder 518 attached to a pivoting brace 520. The brace 520 is pivoted in direction 522 to a position over a carton **400*a* having an open upper side and the gripping arm 512 lowers the sleeved potted plant 480 into the box 400*a*. The carton 400*a* can then be closed and secured for shipping. Alternatively, rather than having the gripper arm 512 move the sleeved potted plant 480 to a specific location in the box 400*a*, the gripper arm 512 may only lift the sleeved potted plant 480 and, the box 400*a* itself may be automatically moved beneath the lifted potted plant 480** to be properly positioned to accept the package lowered thereinto.

Figure 33:
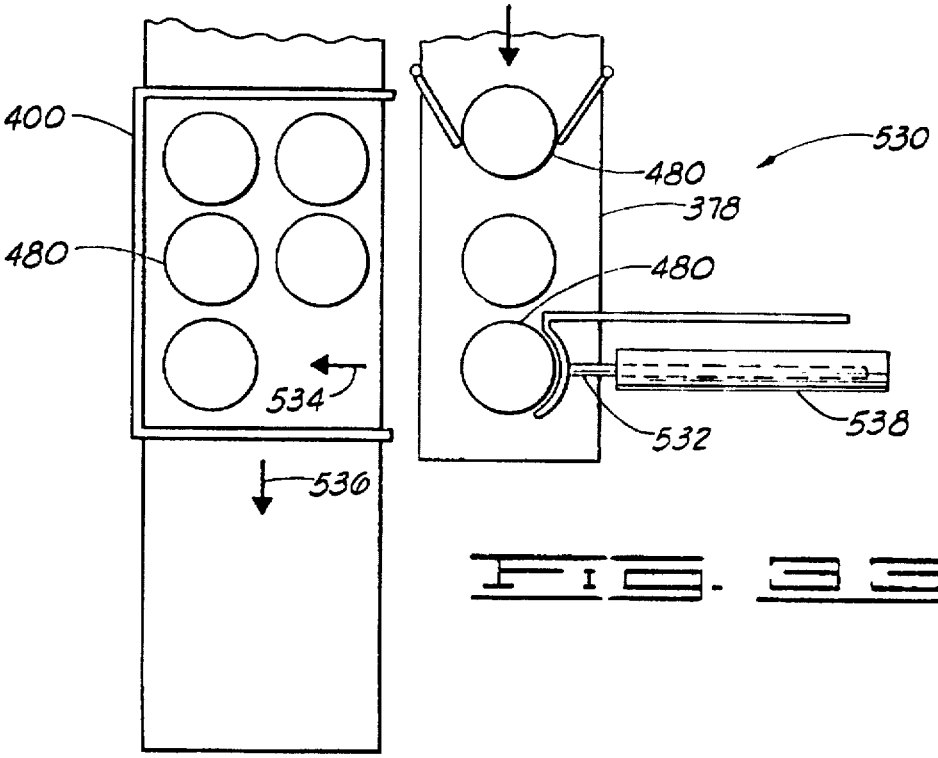
FIG. 33 is a plan view of a boxing system for use in an article packaging system.

Another embodiment of a boxing assembly is designated by the reference numeral 530 and is shown in FIG. 33. Sleeved potted plants 480 are individually directed into an open-sided carton 400 with a pushing arm 532 in direction 534. Sensors (not shown) detect the positions of the sleeved potted plants 480 already within the carton 400 and regulate the action of the pushing arm 532. Once the carton 400 is filled, the carton 400 is closed and secured and moved in direction 536 on the conveyor 396 for shipping. An empty open-sided carton 400 is delivered as a replacement, in one embodiment by an automatic boxing delivery assembly. The extendable pushing arm 532 is indicated in FIG. 33 as being driven by a cylinder 538 but it is understood by one of ordinary skill in the art that there are other mechanisms for causing the advancement and retraction of the pushing arm 532.

PREINSERTION OF COVER INTO SLEEVE

Figure 27A:
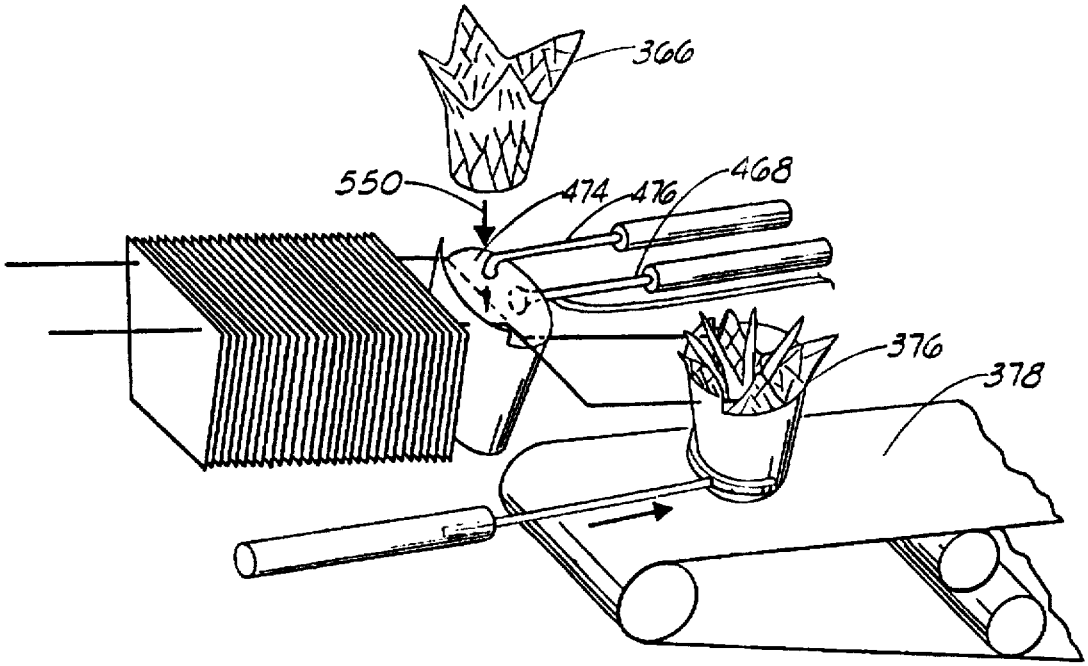
FIG. 27A is a sleeving station modified to receive a pot cover prior to receiving a potted plant.
Figure 27B:
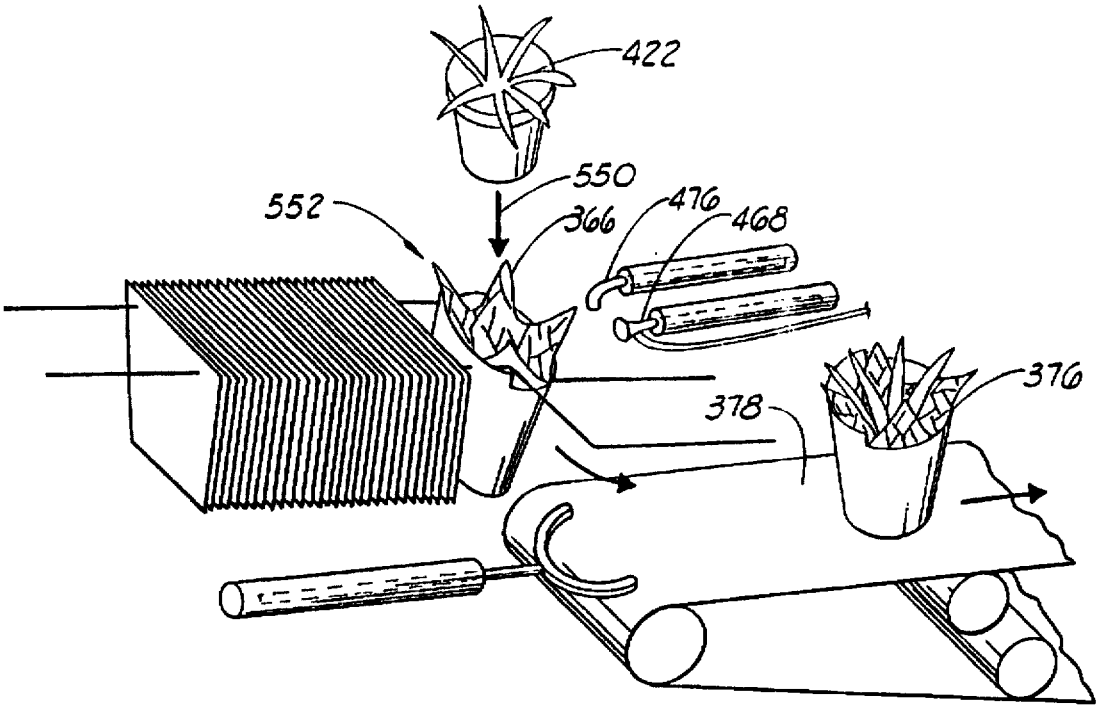
FIG. 27B is the sleeving station of FIG. 27A prepared to receive a potted plant.

Turning now to FIGS. 27A–B and 30A–D, instead of the potted plant 422 being covered by a pot cover 366 prior to insertion into the sleeve 466, the pot cover 366 may be preinserted into the sleeve 466 prior to deposition of the potted plant 422 into the pot cover 366. FIG. 27A indicates that the sleeve 466 is opened in a manner identical to that described for sleeving apparatus 460 in FIG. 24A. The pot cover 366 is then inserted in direction 550 into the opening 474 of the sleeve 466. The suction tube 468 and inflation tube 476 are retracted and the potted plant 422 is deposited in direction 550 into cover/sleeve combination 552 in the same manual or automatic manner as that described previously. The sleeved covered potted plant 376 then is conveyed by the conveyor 378 to the boxing station 404.

Figures 30A, 30B, 30C, 30D:
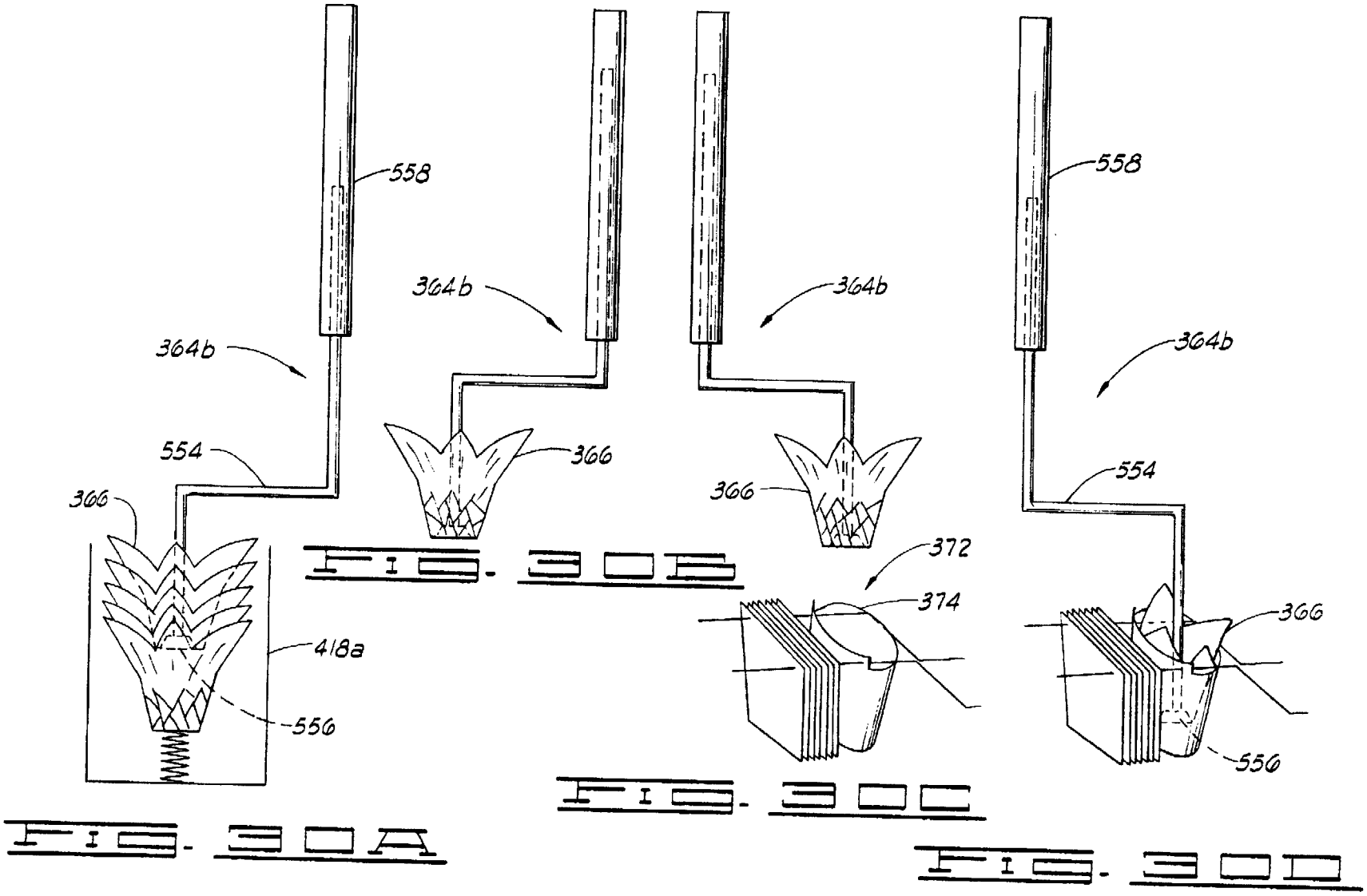
FIG. 30A is an elevational view of another cover supplying device which may be used in an article packaging system.
FIG. 30B is an elevational view of the device of FIG. 30A after a cover has been picked up.
FIG. 30C is an elevational view of the device of FIG. 30A wherein a sleeve is readied to receive a pot cover.
FIG. 30D is an elevational view of the device of FIG. 30A wherein a pot cover has been inserted into a sleeve.

The pot cover 366 may be placed manually into the sleeve 466, but in the preferred embodiment shown in FIGS. 30A–30D, a cover supplying apparatus **364*b* has a retractable cover denesting arm 554 having a suction end 556. The suction end 556 of the denesting arm 554 retrieves a pot cover 366 from a bin 418*b* of pot covers 366 (FIG. 30A). The denesting arm 554 is retracted by a cylinder 558 to remove the pot cover 366 (FIG. 30B) from the bin 418*a*. The pot cover 366 is transferred to the sleeving station 372 (FIG. 30C) and is inserted into the previously opened sleeve 374 (FIG. 30D). Suction is removed from the suction end 556 therein releasing the pot cover 366. The denesting arm 554 is retracted, leaving the pot cover 366 within the sleeve 374 and in readiness for insertion of a potted plant 422** therein using means described herein.

EMBODIMENT OF FIGS. 31–32

Figure 31:
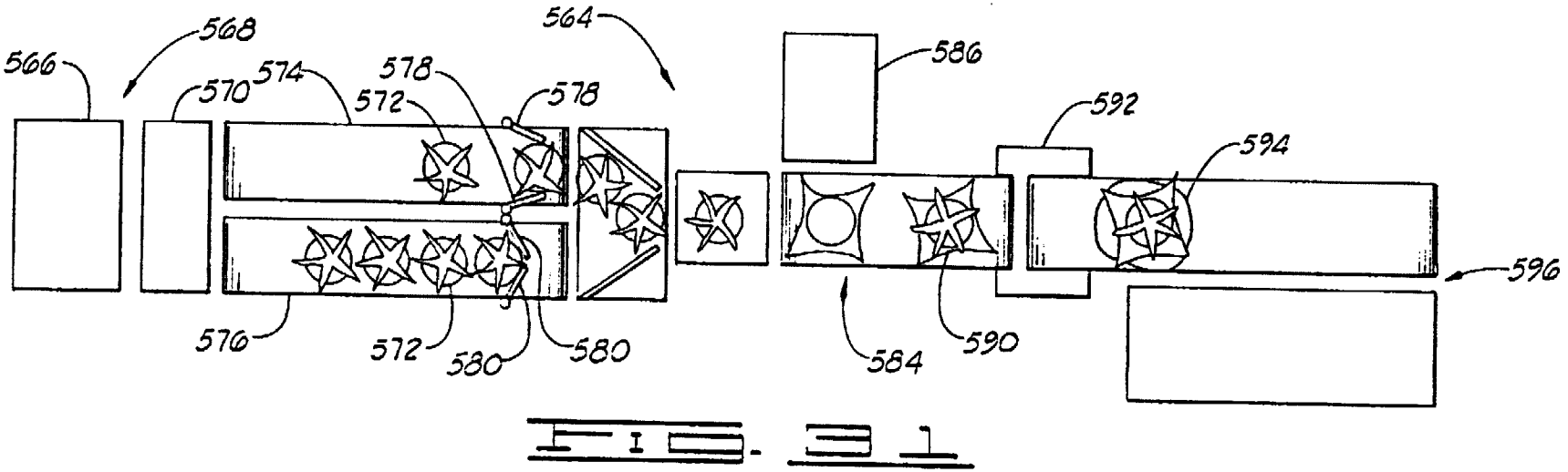
FIG. 31 is a plan schematic view of another article packaging system.
Figure 32:
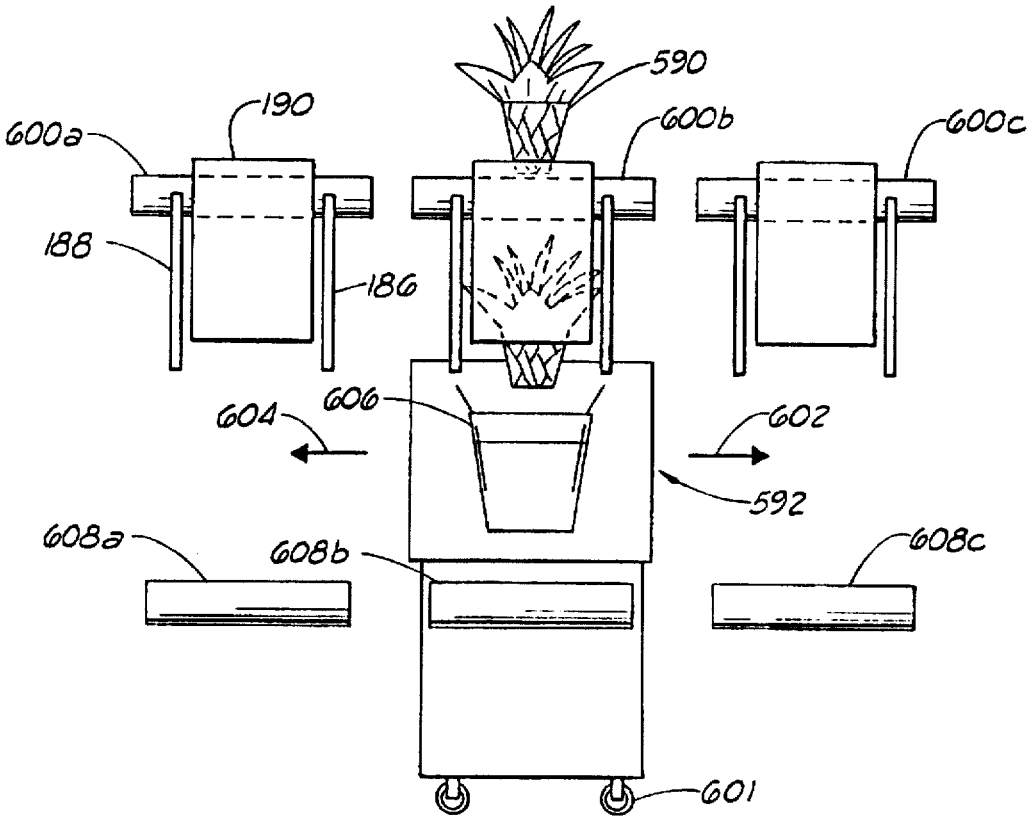
FIG. 32 is a front elevational view of a mobile sleeving station for use with an article packaging system such as that in FIG. 31.

Turning now to FIGS. 31 and 32, another embodiment of the article packaging system is designated by the reference numeral 564. The article packaging system 564 has stations exactly as described for article packaging system 350 as described in FIGS. 22–30 and 33 except that article packaging system 564 employs the same cover supplying apparatus, the same sleeving apparatus and the same boxing and closing devices for all categories of potted plants sorted at the sorting station. The advantage of the article packaging system 564 over the article packaging system 350 is that a single device performs each particular function such as sleeving for all grades or categories. Since duplicate apparatuses are not required for each function, the cost and the space required for the overall system is reduced.

The article packaging system 564, as shown in FIG. 31, has a platform or table 566 serving as a servicing station 568 supporting a set of unsorted potted plants. A sorting station 570, employs a sorter (not shown) of the same type a packaging system 350 which inspects potted plants 572 and sorts them in accordance with predetermined criteria such as size, quality, or variety or any of a number of other criteria. The sorter directs each sorted potted plant 572 to either a first parallel conveyor 574 or a second parallel conveyor 576. Potted plants 572 of a particular category are then accumulated on conveyor 574 by a restraining gate 578 or on conveyor 576 by restraining gate 580 until a predetermined number of the type of potted plant 572 is accumulated. When the predetermined number of sorted potted plants 572 is accumulated, the appropriate gate is opened.

The potted plants 572 are then conveyed to a covering station 584 where a cover supplying apparatus 586 supplies a cover 588 and wherein the cover 588 is applied to the potted plant 572. Each covered potted plant 590 in a particular category is then conveyed to a sleeving station 592 where the covered potted plant 590 is deposited into a sleeve (not shown) in a manner exactly as described herein for article packaging system 350 and its various embodiments. Sleeved potted plants 594 thus produced are then conveyed to a boxing station 596 such as the boxing station 404 or its other embodiments described for system 350 where the sleeved potted plants 594 are placed in cartons 400 which are then closed and secured for shipment.

FIG. 32 shows a version of the article packaging system 564 having a first conveyor **600*a*, a second conveyor 600*b* and a third conveyor 600*c* which lead to the single sleeving station 592. The single sleeving station 592 has rollers 601 and can be rolled or moved in direction 602 or direction 604** between the three conveyors 600a, 600b and 600c manually or automatically for the purpose of supplying sleeves 606 to the potted plants 572 or covered potted plants 590 conveyed thereupon. In this way a single sleeving station 592 can supply sleeves 606 to more than one conveyor 600a, 600b or 600c and category of potted plant 572 to reduce the cost and space required for the system 564.

Alternatively, rather than having a plurality of separate conveyors such as conveyors 600a–600c conveying potted plants 572 to the sleeving station 592, a single conveyor having a plurality of parallel lanes (not shown) could be used. Each parallel lane would have a separately regulated gate (not shown) for allowing accumulation and passage to the sleeving station 592 of a predetermined number of potted plants 572 or covered potted plants 590.

The single sleeving station indicated in FIG. 32 is shown as having separate conveyors 608a–608c for conveying the sleeved potted plants 590 to the appropriate boxing station 596. Each conveyor 608a–608c could direct the sleeved potted plants 594 to a single conveyor (not shown) leading to a single boxing station. Alternatively, each sleeved potted plant conveyor 608a–608c could direct the sleeved potted plants 594 to a separate boxing station 596.

As described herein for article packaging system 350, the article packaging system 564 could be modified in a number of ways. For example, the pot cover 588 could be applied to the potted plant 572 prior to accumulation on conveyor 574 or 576 by gates 578 or 580, respectfully. Or, the pot cover 588 could be placed into the open sleeve 606 prior to the introduction of the potted plant 572 into the sleeve 606, as indicated in the embodiment shown in FIGS. 27A–B.

EMBODIMENT OF FIG. 34

Figure 34:
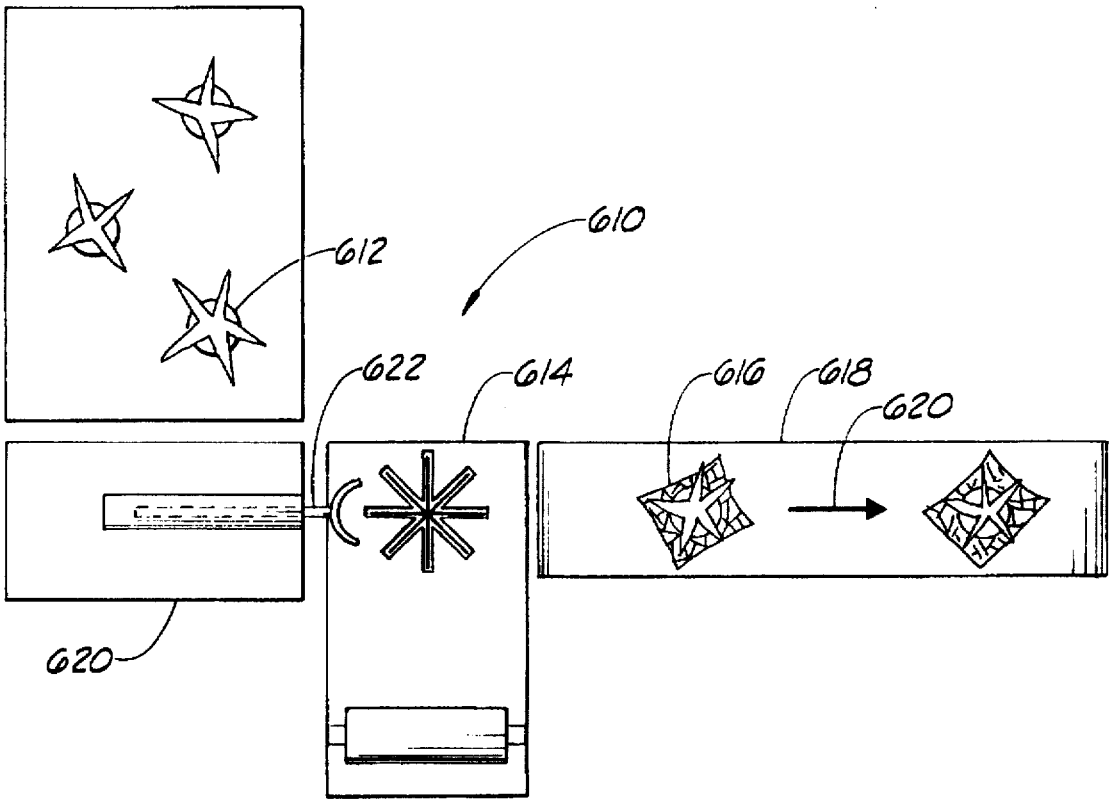
FIG. 34 is a plan view of a portion of another article packaging system in which a cover is applied directly to the article by a cover forming apparatus.

Referring now to FIG. 34, another embodiment of the article packaging system referred to by the reference numeral 610 is illustrated. The article packaging system 610 is constructed exactly as described for article packaging systems 10, 350, or 564 or modifications thereof except that a decorative pot cover is directly formed about the outer surface of a potted plant 612 using an appressing cover forming apparatus such as a cover forming apparatus 614 to form a covered potted plant 616 at a point prior to application of a sleeve to the potted plant 612. The cover forming apparatus 614 appresses a sheet of material (not shown) about the external surface of the potted plant 612 to form a covered potted plant 616 having a cover which may or may not be bonded to the potted plants external surfaces as described herein.

The cover forming apparatus 614 which could be used for example is one described in the patent application filed in the U.S.P.T.O. on Aug. 10, 1992 by Donald Weder, Joseph Straeter and Frank Craig, entitled "Cover Forming Apparatus Having Pivoting Forming Members", and not yet assigned a serial number, the specification of which is hereby specifically incorporated herein. This does not exclude the use of other types of cover forming apparatuses adapted for forming a cover about the outer surface of a potted plant to form the covered potted plant 616.

After the potted plant has been covered by the cover forming apparatus 614, the covered potted plant 616 is transferred to a conveyor 618 moving in direction 620 toward a sleeving station exactly the same as other sleeving stations previously described herein. The relocation of the covered potted plant 616 from the cover forming apparatus 614 can be accomplished manually or automatically such as by a transfer device 620 having an extendable pushing arm 622 or by some other device adapted for moving the covered potted plant 616 to a conveyor 618.

Changes may be made in the combinations, operations and arrangements of the various parts and elements described herein without departing from the spirit and scope of the invention as defined in the following claims.

What is claimed is:

1. A method of packaging a potted plant comprising the steps of:

providing a sleeving station having automatic sleeving means for automatically applying a preformed sleeve;

automatically opening the preformed sleeve and disposing a decorative cover into the opened preformed sleeve;

providing a plurality of potted plants, each having an exterior surface;

sequentially conveying each potted plant to the sleeving station via conveying means having a distal end near the sleeving station; and sequentially delivering each potted plant to guiding means arranged at the distal end of the conveying means through which guiding means each potted plant is automatically passed downwardly and then automatically oriented and maintained in an upright orientation for placement into an opened sleeve and placing each such uprightly oriented potted plant into the opened sleeve and into the cover therein forming a sleeved covered potted plant.

2. The method of claim 1 further comprising the step of:

sequentially sorting each potted plant at a sorting station into one of at least two grades in accordance with a predetermined grading criterion.

3. A method of packaging a potted plant comprising the steps of:

providing a plurality of potted plants, each having an exterior surface;

applying a decorative cover about the exterior surface of each potted plant to form a covered potted plant; and sequentially delivering each potted plant via conveying means to guiding means arranged near an end of the conveying means through which guiding means each covered potted plant is automatically passed downwardly and thereby automatically oriented and maintained in an upright orientation for placement into an opened sleeve and placing each such uprightly oriented covered potted plant into an opened sleeve forming a sleeved covered potted plant.

4. The method of claim 3 wherein in the step of providing a potted plant, the potted plant further comprises a living potted plant.

5. A method of packaging a potted plant comprising the steps of:

providing a plurality of potted plants, each having an exterior surface;

sorting each potted plant into one of at least two grades in accordance with a predetermined grading criterion;

applying a decorative cover about the exterior surface of each potted plant to form a covered potted plant; and sequentially delivering each covered potted plant via conveying means to guiding means arranged near an end of the conveying means through which guiding means each covered potted plant is automatically passed downwardly and thereby automatically oriented and maintained in an upright orientation for placement into an automatically opened sleeve and placing each such uprightly oriented covered potted plant into an opened sleeve forming a sleeved covered potted plant.

6. A method of packaging potted plants comprising the steps of:

providing a covering station having automatic covering means for automatically applying a decorative cover;

providing a plurality of potted plants, each having an exterior surface;

sequentially moving each potted plant toward the covering station via conveying means;

automatically transferring the potted plant from the conveying means to the covering station by gripping the potted plant via gripping means at a position on the conveying means and automatically delivering the gripped potted plant in an upright position to the covering station where a decorative cover is automatically applied about the exterior surface of each potted plant to form a covered potted plant;

automatically removing the covered potted plant from the covering station; and automatically moving the covered potted plant to a sleeving station where a sleeve is automatically applied about the covered potted plant.

7. A method of packaging potted plants comprising the steps of:

providing a covering station having automatic covering means for automatically applying a decorative cover;

providing a sleeving station having automatic sleeving means for automatically applying a preformed sleeve;

providing a plurality of potted plants, each having an exterior surface;

sequentially moving each potted plant toward the covering station via conveying means;

automatically delivering the potted plant from the conveying means in an about upright position to the covering station;

automatically applying the decorative cover about the exterior surface of each potted plant at the covering station to form a covered potted plant;

automatically opening the preformed sleeve;

sequentially conveying each potted plant to the sleeving station via second conveying means; and sequentially delivering each potted plant to the sleeving station oriented and maintained in an about upright orientation for placement into the opened sleeve and placing each such uprightly oriented potted plant into the opened sleeve forming a sleeved covered potted plant.

8. The method of claim 7 further comprising the step of:

sequentially sorting each potted plant at a sorting station into one of at least two grades in accordance with a predetermined grading criterion.

* * * * *